US012484615B1

(12) United States Patent
Mou

(10) Patent No.: US 12,484,615 B1
(45) Date of Patent: Dec. 2, 2025

(54) HOLDER DEVICE FOR COUPLING SMOKABLE ITEMS WITH SMOKING INSTRUMENTS

(71) Applicant: Coconut Concepts LLC, Keller, TX (US)

(72) Inventor: Angela Mou, Keller, NE (US)

(73) Assignee: Coconut Concepts LLC, Keller, TX (US)

( * ) Notice: Subject to any disclaimer, the term of this patent is extended or adjusted under 35 U.S.C. 154(b) by 0 days.

(21) Appl. No.: 18/889,784

(22) Filed: Sep. 19, 2024

(51) Int. Cl.
*A24F 1/30* (2006.01)

(52) U.S. Cl.
CPC ..... *A24F 1/30* (2013.01)

(58) Field of Classification Search
None
See application file for complete search history.

(56) References Cited

U.S. PATENT DOCUMENTS 809,325 A * 1/1906 Probyn ..... A24F 1/30 131/179
1,395,320 A * 11/1921 Williams ..... A24F 13/14 131/175
1,692,971 A * 11/1928 Alland ..... A24F 1/30 131/179
2,109,810 A * 3/1938 Walsh ..... A24F 13/14 131/175
3,805,806 A * 4/1974 Grihalva ..... A24F 1/30 D27/162
3,902,506 A * 9/1975 Hawie ..... A24F 1/30 131/173
2020/0253273 A1* 8/2020 Hines ..... A24F 13/22
2023/0148659 A1* 5/2023 Capiti ..... A24F 13/12 131/330

* cited by examiner

*Primary Examiner* — Dennis R Cordray
(74) *Attorney, Agent, or Firm* — Cohen I.P. Law Group, PC; Michael N. Cohen

(57) ABSTRACT

A holder device for coupling a smokable item (e.g., a pre-roll cone, an empty cone, a pre-rolled or hand-rolled cigarette, a cigar, etc.). The holder device includes a passageway formed and dimensioned to provide upper and lower lateral support to the smokable item, as well as the forces necessary to secure the smokable item within the passageway when inserted therein. The holder device may be coupled to a smoking instrument, e.g., to a down stem of a waterpipe, thereby enabling the smokable item to be smoked via the instrument instead of being handheld during the smoking experience. The holder device also may include an integrated ashtray.

16 Claims, 23 Drawing Sheets

(State of the art)

(State-of-the-art)

HOLDER DEVICE FOR COUPLING SMOKABLE ITEMS WITH SMOKING INSTRUMENTS

FIELD OF THE INVENTION

The present invention relates to smoking devices, including a holder device for coupling cones, pre-rolls, blunts, cigarettes, and other smokable items to a smoking instrument such as, but not limited to, a waterpipe.

BACKGROUND

Smokable items such as pre-rolls, blunts, joints, cigarettes and cigars are well known and smoked for pleasure throughout the world.

However, while smoking such smokeable items, the items may leave a residue on the user's fingers that causes the fingers to become discolored and to smell of the smokable item, both of which may be unpleasant and undesirable.

In addition, many such smokable items do not include filtering such that the user may inhale unfiltered smoke that may include carcinogens. Also, smoke produced by such smokable items may be extremely hot and may cause damage to the user's mouth, throat and/or lungs.

Accordingly, there is a need for a smokable item holder that enables the smokable item to be coupled to and smoked using a smoking instrument. For example, there is a need for a smokable holder that enables a smokable item to be configured with a waterpipe such that the user may not physically touch the smokable item during the smoking experience, and such that the smoke produced by the smokable item may be filtered and cooled by the waterpipe.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
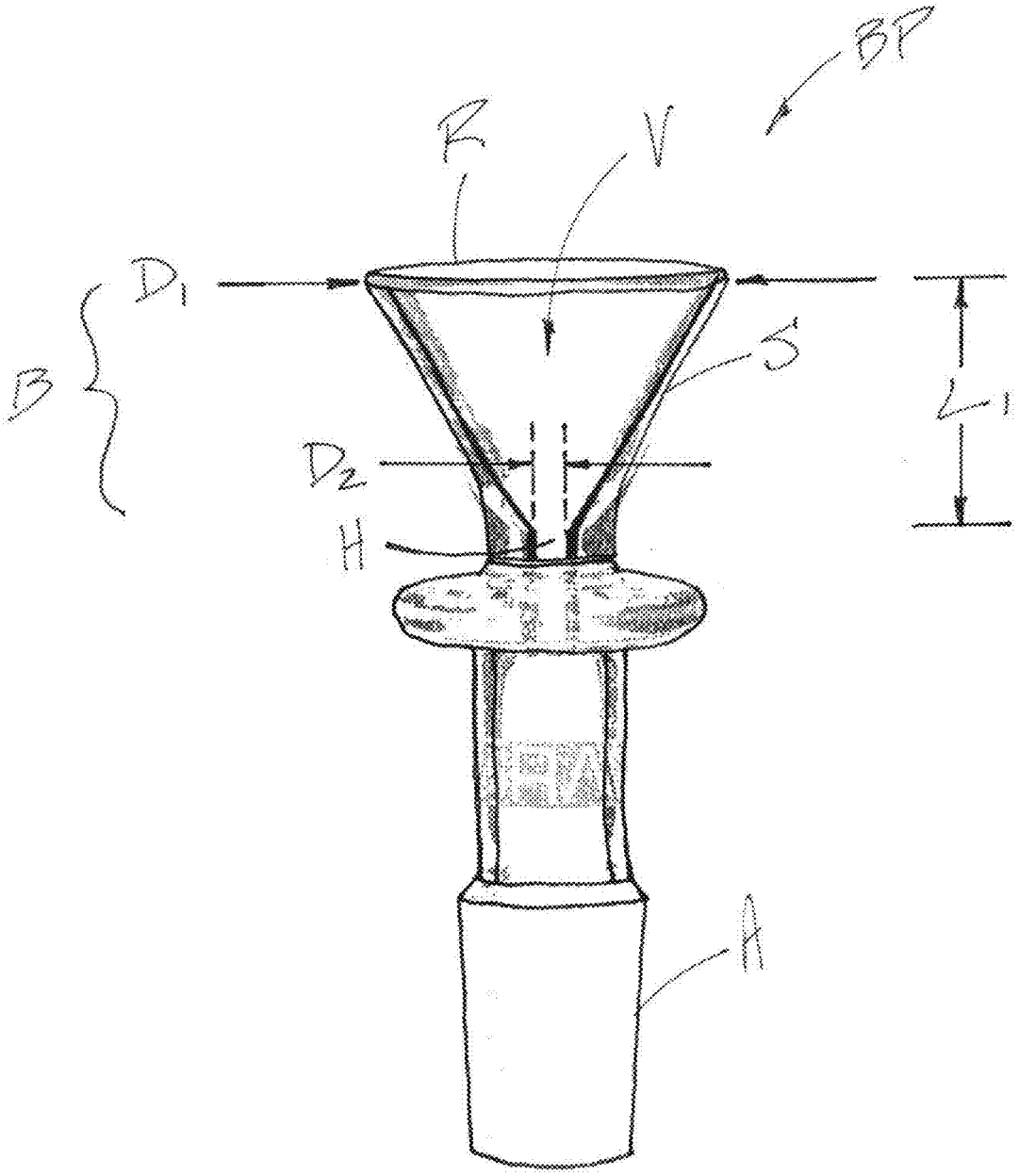
FIG. 1 shows a state-of-the-art bowl piece.

For the purposes of this specification, unless otherwise stated, the terms below will mean the following.

Cone generally refers to a conical- or frustum-shaped smokable item, e.g., a cigarette (or "joint"), wherein the shape of the smokable item flares from a smaller diameter proximal mouth end to a larger diameter distal end. Cones may typically comprise paper, hemp, palm leaves, rice, cotton cellulose, glycerin, and/or other suitable materials. The cone may or may not include a mouthpiece (typically comprising rolled paper or cardboard) at the mouth end for the user to hold in his/her mouth while smoking.

Pre-roll generally refers to a smokable item, e.g., a cigarette or cone, that has been formed prior to its sale, includes a smokable material within the cigarette or cone, and is therefore consumer-ready and ready to smoke (i.e., a consumer is not required to fill or otherwise form the smokable).

Empty cone refers to an empty cone into which a consumer may place smokable materials (e.g., tobacco, cannabis, etc.) to form a smokable cone.

Cigarette generally refers to a smokable item comprising a thin cylinder (also referred to as a rod) of finely cut tobacco, cannabis, other types of leaves, flowers, herbs, and/or other smokable materials, rolled in a suitable paper for smoking.

Mouthpiece refers to a tip coupled with the mouth end of a cone, cigarette, or other smokable item that acts to support the proximal end of the smokable (e.g., the end that is pressed against one's lips for smoking) and to provide one or more surfaces for the user to hold the mouthpiece with his/her mouth (e.g., lips, teeth, etc.) while smoking. Such mouthpieces are typically formed of rolled paper or cardboard.

In general, and according to exemplary embodiments hereof, a holder device 10 designed to receive and hold the mouth end (e.g., the mouthpiece) of a smokable item (e.g., a cone, pre-roll, rod, etc.) and to couple the mouth end to a smoking instrument (e.g., to a waterpipe or "bong") is provided. In use, the holder device 10 (also referred to herein as simply the holder and/r the device) is configured with the smoking device (with the waterpipe) and the mouth end of the smokable item is inserted into and secured within the holder device 10. In this way, once the smokable item is inserted into the holder device 10, the user does not physically handle the smokable item during the smoking experience, and thereby may avoid getting unpleasant smelling residue on his/her fingers. In addition, because the user may smoke the smokable item via the waterpipe, the user also may experience the benefits of smoking via the waterpipe vs. directly smoking the smokable item. These benefits may include cooling of the smoke as it passes through the water within the waterpipe, filtering of the smoke as the smoke passes through the water within the waterpipe, cooling of the smoke as the smoke passes through the body (typically glass) of the waterpipe, and other benefits.

For the purposes of this specification, the smokable item will be described primarily as a pre-roll cone (or simply as a cone) with a mouthpiece (e.g., rolled paper or cardboard) coupled to a portion containing smokable materials (e.g., tobacco, herbs, etc.), and the smoking instrument will be described primarily as a waterpipe (e.g., a bong). However, it is understood that the holder device 10 may be used with any type of suitable smokable item including, but not limited to, a pre-roll, a cone, a cigarette, a blunt, a joint (e.g., without a mouthpiece), other types of smokable rods, and/or any combinations thereof, and that the scope of the holder device 10 is not limited in any way by the type of smokable item that it may be used with. It also is understood that the holder device 10 may be used with other types of smoking instruments in addition to waterpipes, including, but not limited to, bubblers, pipes, rigs, hookahs, ash catchers, other types of smoking instruments, and/or any combinations thereof, and that the scope of the holder device 10 is not limited in any way by the type of smoking instrument that it may be used with.

To provide clarity regarding the inventive aspects of the inventive holder device 10, the state-of-the-art bowl members and accompanying waterpipe instruments will first be summarized.

Figure 2:
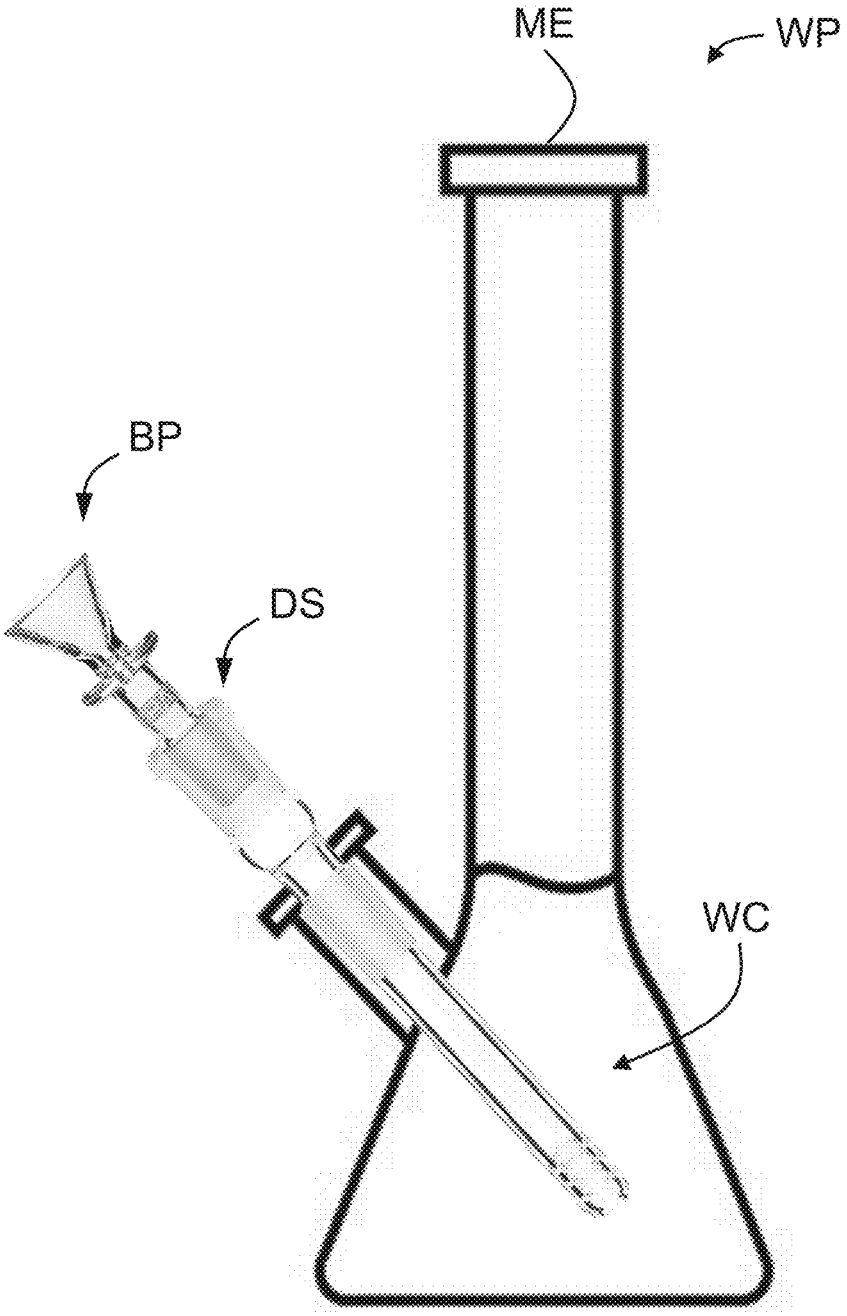
FIG. 2 shows a state-of-the-art bowl piece configured with a waterpipe.

FIG. 1 shows a state-of-the-art bowl piece BP for use with a waterpipe WP, and FIG. 2 shows the bowl piece BP configured with the waterpipe WP for use. The bowl piece BP (typically formed of glass) includes a bowl B including an upper rim R and sidewalls S defining an inner volume V. As shown, the upper rim R defines the open top end of the bowl B with diameter D1 of about 20 mm-25 mm through which a user may place smokable materials (e.g., finely cut tobacco or herbs) into the inner volume V to be ignited and smoked. The sidewalls S taper inward from the upper rim R to the bottom of the inner volume V thereby forming an inverted cone with a height L1 of about 10 mm-12 mm. At the far bottom of the inner volume V, the bowl B includes a through hole H through which smoke from the ignited smokable materials within the inner volume V may pass during use. The through hole H is dimensioned to be small enough to disallow the finely cut smokable material to pass through while being large enough to allow smoke to pass. For example, typical through holes H of typical bowl pieces BP may have a diameter D2 of about 2 mm-3 mm.

As described above, the standard bowl piece BP is designed with a wide-open upper opening (e.g., 20 mm-25 mm wide) to enable a user to easily place smokable materials into the bowl piece BP using only his/her fingers. That is, the user may place the smokable materials into the wide opening of the bowl piece BP and then have ample room to insert the tip of his/her finger into the top of the bowl piece BP to pack the materials downward into the bowl piece's inner volume V. In this way, the smokable materials may be properly packed within the bowl piece BP for ignition.

The bottom of the bowl piece BP includes a hollow adapter A in fluid communication with the through hole H and designed to be received into a corresponding adapter on a down stem DS to configure the bowl piece BP with the waterpipe WP as described below.

As shown in FIG. 2, the bowl piece BP may be configured with a waterpipe WP by inserting the bowl piece's lower adapter A into the corresponding upper adapter of the down stem DS. The down stem is configured to pass through an opening in the side of the waterpipe WP such that the distal end of the down stem DS is submerged in water within the waterpipe's water chamber WC. During use, the user places finely ground smokable materials (e.g., ground tobacco or herbs) into the bowl piece's inner volume V, ignites the smokable materials, and then inhales through the top mouth end ME of the waterpipe WP. Smoke from the ignited materials within the bowl piece BP is caused to flow downward through the through hole H, through the down stem DS, through the water within the waterpipe's water chamber WC, and then upward and into the user's mouth and lungs. Meanwhile, the through hole H at the bottom of the bowl piece BP is small enough to contain the ashes resulting from the ignition of the smokable materials to within the bowl's inner volume V. The bowl piece BP may then be lifted upward to remove it from the down stem DS and turned upside down to remove the ashes therewithin (e.g., by tapping the rim R of the inverted bowl piece BP into an ash tray). At this point, the empty bowl piece BP may be inserted back into the top of the waterpipe's down stem DS to be reloaded for continued use.

On the other hand, smokable items, such as pre-roll cones, typically include mouth pieces with lower end diameters of about 4 mm-5 mm and upper end diameters of about 6 mm-8 mm. As such, it is clear that state-of-the-art bowl pieces BP are not designed to receive and hold smokable items such as pre-roll cones. For example, if the mouthpiece of a pre-roll cone were to be inserted into the state-of-the-art bowl piece BP of FIG. 1, the bowl piece BP would provide little to no lateral support to the cone. That is, the bottom end of the cone mouthpiece would simply rest against the bottom through hole H of the bowl B (it would not enter into the through hole H given that the diameter of the cone's bottom end is wider than the diameter D2 of the through hole H) and the body of the cone mouthpiece would tilt sideways while resting unsupported against a side of the bowl's upper rim R. The bowl's upper rim R, being about 20 mm-25 mm, would provide no lateral support to the cone mouthpiece that would prevent the cone mouthpiece from flopping side-to-side within the bowl B. As such, use of a state-of-the-art bowl piece BP would not adequately secure a pre-roll cone, potentially allowing the cone to easily fall out of the bowl piece BP. Accordingly, if the cone were to be ignited and were to fall from the bowl piece BP, a very dangerous situation may ensue. Given the above, state-of-the-art bowl pieces BP should not be used to couple smokable items such as pre-roll cones to a smoking instrument such as a waterpipe.

Furthermore, if a state-of-the art bowl piece BP were to be modified to accommodate a pre-roll cone by increasing the diameter D2 of the bowl's lower through hole H, the through hole H would no longer perform its intended functionality of preventing ash and smokable material within the bowl B to pass through the through hole H. That is, the through hole H would be too large to hold ash and smokable materials within the bowl B, and as such, the ash and smokable materials would easily pass through the hole H. This would adversely affect the bowl piece's performance resulting in an unacceptable design parameter.

Next, the inventive holder device 10 will be described in relation to the figures.

Figure 3:
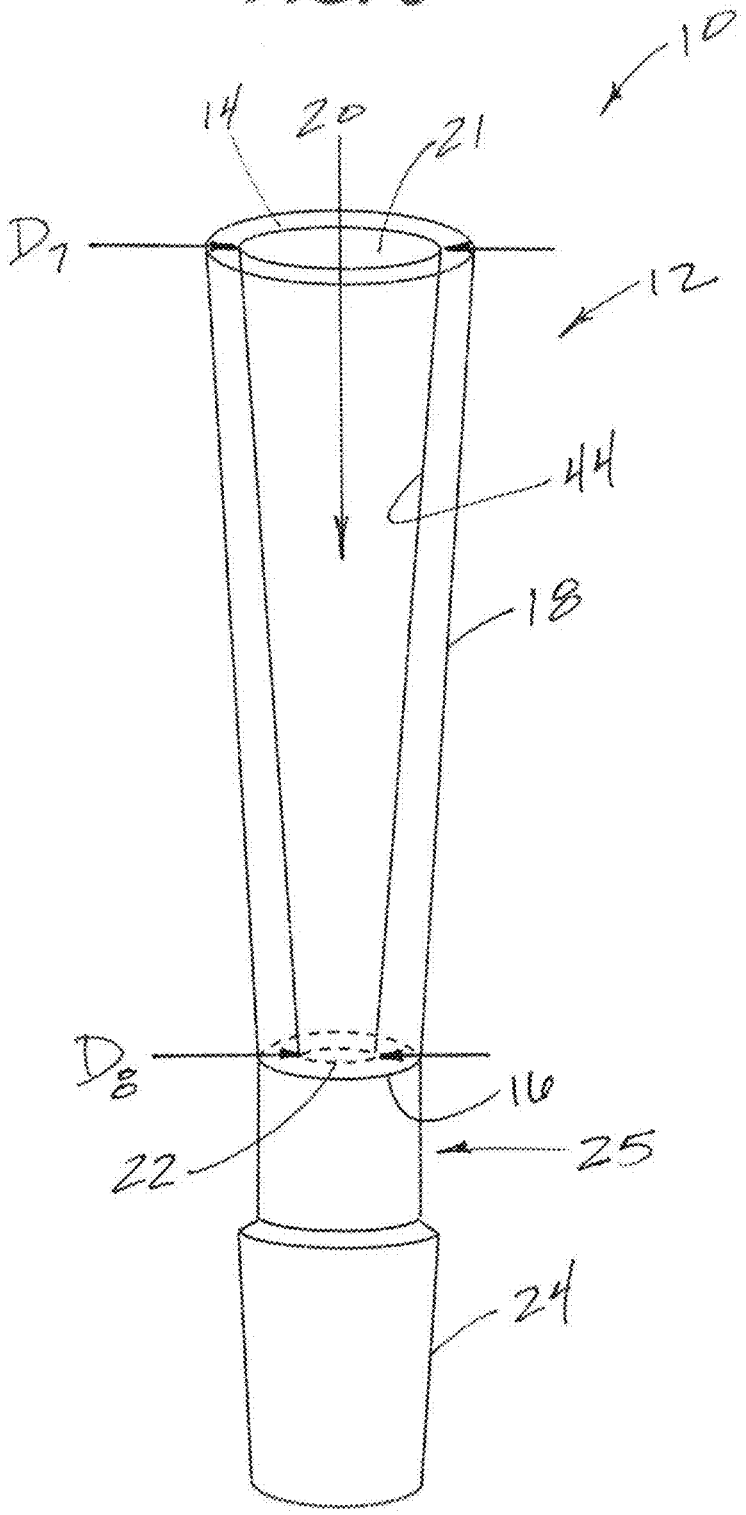
FIG. 3 shows a holder device according to exemplary embodiments hereof.

In some embodiments, as shown in FIG. 3, the inventive holder device 10 includes a holder body 12 including a first end 14 and a second end 16 and outer sidewalls 18 extending between the first end 14 and the second end 16. The holder device 10 also includes an inner passageway 20 including a first opening 21 and a second opening 22 and inner sidewalls 44 extending from the first opening 21 to the second opening 22. In this way, the first opening 21 is in fluid communication with the second opening 22 via the inner passageway 20. In some embodiments, the inner passageway's first opening 21 may correspond to (e.g., be located at) the holder body's first end 14 and the passageway's second opening 22 may correspond to (e.g., be located at) the holder body's second end 16. However, depending on the architecture of the holder device 10 and its holder body 12, in some embodiments, the holder body 12 may extend outward beyond the passageway's first and/or second openings 21, 22 (e.g., the holder body 12 may include ornamental and/or other elements that may extend outward beyond the first and/or second openings 21, 22).

In some embodiments, as described herein, the inner passageway 20 (e.g., its first opening 21) is designed to receive and secure the mouth end of a pre-roll cone.

As shown in FIG. 3, in some embodiments, the first opening 21 includes a diameter D7 and the second opening 22 includes a diameter D8, with diameter D7 being larger than diameter D8 (D7>D8). Given this, the inner sidewalls 44 may taper inward and may be generally linear from the first opening 21 to the second opening 22 thereby forming a frustum shaped passageway 20. However, it also is contemplated that diameter D7 may generally match diameter D8 such that the inner sidewalls 44 may not necessarily taper inward and instead may form a cylindrical passageway 20. In other embodiments, diameter D8 may be greater than diameter D7 so that the passageway 20 forms an inverted frustum shape. This will be described in detail in other sections.

In some embodiments, the device 10 may include a hollow lower adapter 24 designed to mate the device 10 with a down stem of a waterpipe (e.g., similar to the adapter A shown in FIGS. 1-2).

In some embodiments, the device 10 may include a hollow transition portion 25 between the second end 16 (e.g., at or near where the second opening 22 may be positioned) and the adapter 24. As will be described in other sections, the transition portion 25 may include additional structures and/or forms that may provide additional benefits to the holder device 10. For example, the transition portion 25 may include an angular translation (e.g., a bend), a hollow coil (for adding length to the device 10 and thereby additional pathway length for the smoke to cool), ornamental aspects, etc.

It may be preferable for the adapter 24 and the transition portion 25 to be in fluid communication with the passageway 20 (e.g., with the passageway's second opening 22) so that smoke passing into the first opening 21 of the passageway 20 may sequentially pass through the passageway 20, out the passageway's second opening 22, through the transition portion 25, and through and out the bottom of the adapter 24. The smoke may then pass through the down stem and through the waterpipe.

In some embodiments, the inner passageway's second opening 22 may be generally integrated with (e.g., may merge into) the passageway that may pass through the hollow adapter portion 25 and/or through the hollow adapter 24, and it is understood that the inner passageway's second opening 22 may be located anywhere before, at, within, and/or after the hollow transition portion 25 and/or the hollow adapter 24.

In use, in some embodiments, the device 10 is configured with a waterpipe by inserting the device's lower adapter 24 into an upper portion of a down stem configured with the waterpipe as described above (see FIG. 2). In this way, the device's first opening 21 and inner passageway 20 are in fluid communication with the path of the smoke as it passes through the waterpipe during use as described above.

Figure 4:
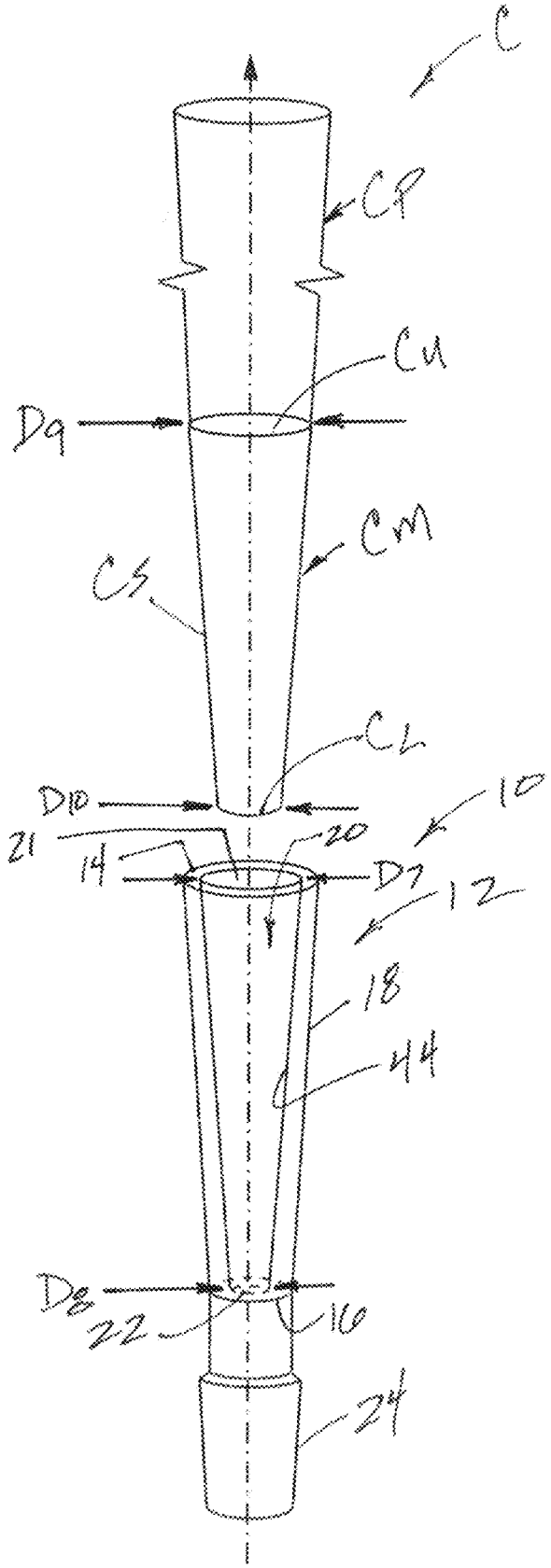
FIG. 4 shows a holder device aligned with a smokable item according to exemplary embodiments hereof.

FIG. 4 shows a pre-roll cone C aligned with the holder device 10 along a shared vertical axis. As shown the pre-roll cone C includes a cone mouthpiece $C_M$ (e.g., comprising rolled paper or cardboard) including an upper mouthpiece end $C_U$ with a diameter D9 and a lower mouthpiece end $C_L$ with a diameter D10. The cone mouthpiece $C_M$ also may include outer circumferential sidewalls $C_S$ that extend generally linearly from its upper end $C_U$ to its lower end $C_L$. The cone C also may include a pre-roll paper portion $C_P$ coupled to the cone mouthpiece $C_M$ (e.g., to its upper end $C_U$) wherein the smokable materials (e.g., tobacco or herbs) may be placed for ignition and smoking.

Figure 5:
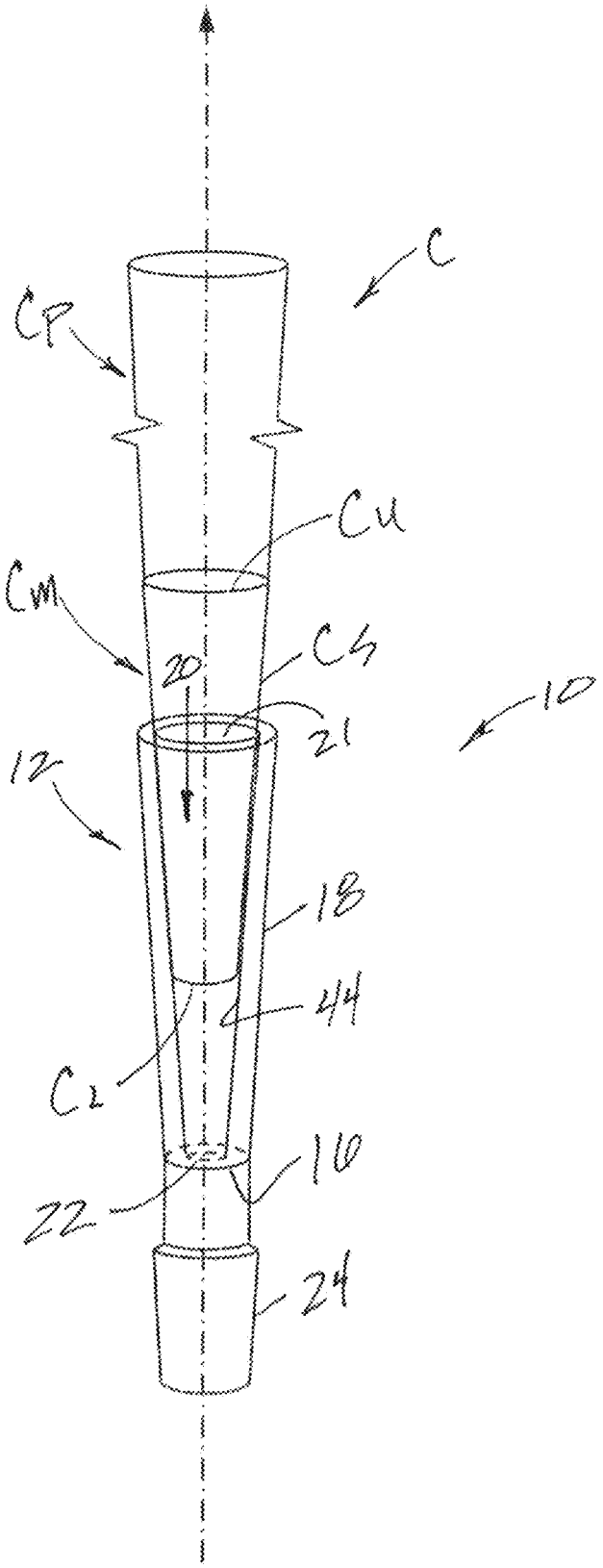
FIG. 5 shows a holder device configured with a smokable item according to exemplary embodiments hereof.

FIG. 5 shows the pre-roll cone C inserted into the holder device's inner passageway 20 through the first opening 21 and held therein.

In some embodiments, as shown in FIG. 5 and as described in further detail in other sections, the upper diameter D7 of the passageway 20 may preferably generally equal the diameter of the cone mouthpiece $C_M$ at an intermediary location between the cone mouthpiece's upper end $C_U$ and its lower end $C_L$. In this way, with the cone mouthpiece inserted and nestled within the passageway 20 with its sides $C_S$ flush against the inner sidewalls 44 of the passageway 20, the cone mouthpiece $C_M$ may be generally held in place.

In some embodiments, a typical cone mouthpiece $C_M$ may have a lower diameter D10 of about 4 mm-5 mm and an upper diameter D9 of about 6 mm-7 mm. In addition, typical cone mouthpieces $C_M$ may have a length of about 26 mm. In some embodiments, with the cone mouthpiece $C_M$ secured within the passageway 20 as shown in FIG. 5, the diameter of the cone mouthpiece $C_M$ at the passageway's upper end 14 may generally match the upper diameter D7 of the passageway 20. Accordingly, it may be preferable for the passageway's upper diameter D7 to be about 5 mm to about 6 mm given the typical diameters D9, D10 of a typical cone mouthpiece $C_M$. In addition, because a typical cone mouthpiece $C_M$ may be about 26 mm in length, it may be preferable for the passageway 20 (and the holder body 12) to be about 15 mm to about 25 mm so that an adequate portion of the cone mouthpiece $C_M$ is held within the passageway 20 for use. This also may provide a small portion of the cone mouthpiece $C_M$ to extend out of the passageway 20 to be gripped by the user to remove the cone mouthpiece $C_M$ from the passageway 20 when desired.

Given these preferred dimensions of the passageway 20, it can be seen that such a dimensioned passageway 20 would not be functional for use with a standard bowl piece BP described in relation to FIGS. 1 and 2 intended to receive tobacco and/or herbs. That is, a user would have difficulty in loading the tobacco or herbs into the passageway 20 given the passageway's small upper diameter D7. Indeed, an upper diameter D7 of only about 5 mm to 6 mm would not allow the fingertip of the user to enter into the passageway's inner volume to pack the smokable materials downward, and as such, the passageway 20 would be inadequate for loading and holding such materials to be ignited and smoked. Additionally, the lower opening H in a standard bowl piece BP is too small to receive and accommodate the lower end $C_L$ of a cone mouthpiece $C_M$, and any attempt to increase the diameter D2 of the bowl's lower opening H would destroy the hole's ability to prevent ash and smokable materials from passing through the hole H. Given this, it is clear that the inventive device 10 and its inner passageway 20 are not functional as a standard bowl piece BP.

Further details of the device 10 are described below.

Sidewall Hold

Figure 6:
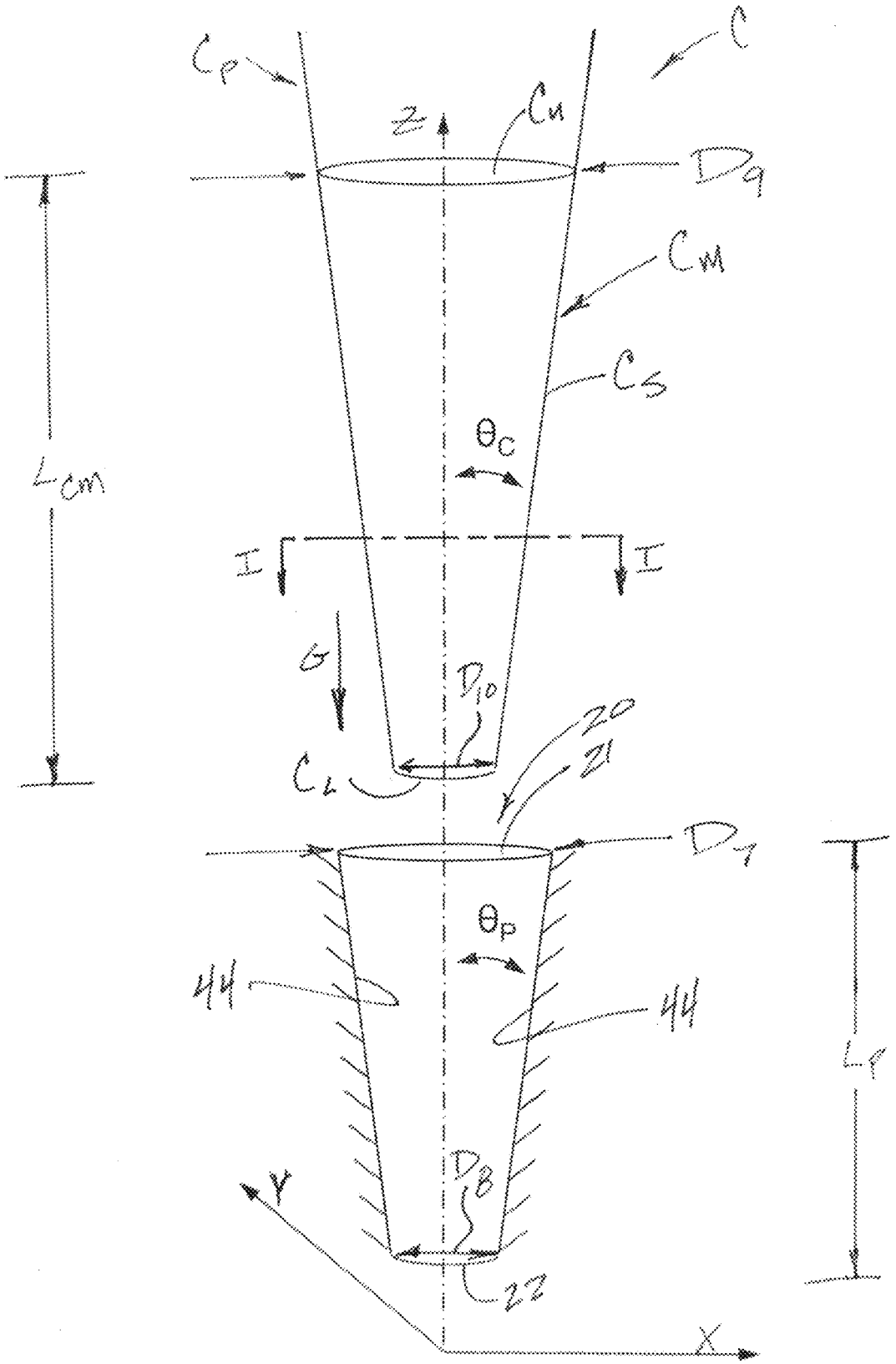
FIG. 6 shows a smokable item aligned with a holder device passageway according to exemplary embodiments hereof.

FIG. 6 shows an inner passageway 20 aligned with a cone C that may be received into the inner passageway 20 and held therein. The inner passageway 20 is shown generally isolated from the holder body 12 for clarity, and it is understood that any suitable holder body 12 may be used to include the passageway 20. The cone C and the passageway 20 are shown along a common vertical axis Z. The inner passageway 20 may include a first end opening 21 (e.g., at its distal end) and a second end opening 22 (e.g., at its proximal end). In some embodiments, the first end opening 21 includes a first opening diameter D7, the second end opening 22 includes a second opening diameter D8, and the passageway 20 includes inner circumferential sidewalls 44 extending from the first opening 21 to the second opening 22 (or at least partially thereof). The passageway 20 also includes a length $L_P$ measured from its first end opening 21 to its second end opening 22 along the vertical axis Z. For the purposes of this specification, unless specifically described as otherwise, the length $L_P$ of the passageway 20 also will represent the length of the overall holder body 12 given that, in some embodiments, these lengths are generally equal.

For the purposes of this specification, aspects of the inner passageway 20, its first and second openings 21, 22 and its inner sidewalls 44 will be described primarily in regard to the inner passageway 20 receiving and securing a mouth end of a cone mouthpiece (e.g., a pre-roll cone). However, it is understood that this is for demonstration and that the passageway 20, its openings 21, 22 and its inner sidewalls 44 may be formed to receive any type of smokable items (e.g., the mouth end of a joint or cigarette) and that the scope of the system 10 is not limited in any way by the type of smokable item that it may be used with.

Furthermore, when the length $L_P$ of the passageway 20 is referenced herein, for the purposes of this specification, this length $L_P$ may generally correspond to the length of the portion of the passageway 20 designed to implement the cone mouthpiece. As such, it is understood that the passageway 20 may include additional portions with additional lengths outside of the portion with length $L_P$ (e.g., above and/or below the first and second openings 21, 22). These additional portions with additional lengths may include ornamental elements, passageway extension elements (e.g., to extend the length of the path for the smoke so that the smoke may be further cooled), portions of the transition portion 25 and/or of the adapter 24, as well as other elements.

In some embodiments, as shown in FIG. 6, the cone C to be received into the inner passageway 20 and held therein may include a cone mouthpiece $C_M$ including a mouthpiece upper end $C_U$ with a diameter D9 and a mouthpiece lower end $C_L$ with a diameter D10. The cone mouthpiece $C_M$ also may include outer circumferential sidewalls $C_S$ that extend generally linearly from its upper end $C_U$ to its lower end $C_L$, and a length $L_{CM}$ measured between its upper end $C_U$ to its lower end $C_L$. As is known, a cone C and its mouthpiece $C_M$ may commonly be formed as a conical frustum such that D9 may be larger than D10. Given this, as is shown in FIG. 6, the cone's outer sidewalls $C_S$ may taper inward from its upper end $C_U$ to its lower end $C_L$ at a cone outer sidewall angle $\theta_C$ with respect to the vertical axis. In other examples, however, e.g., in the case of the smokable item being a cigarette (instead of a cone), the outer sidewall angle $\theta_C$ may be substantially zero degrees (i.e., the cigarette mouthpiece may be generally cylindrical).

Figure 7:
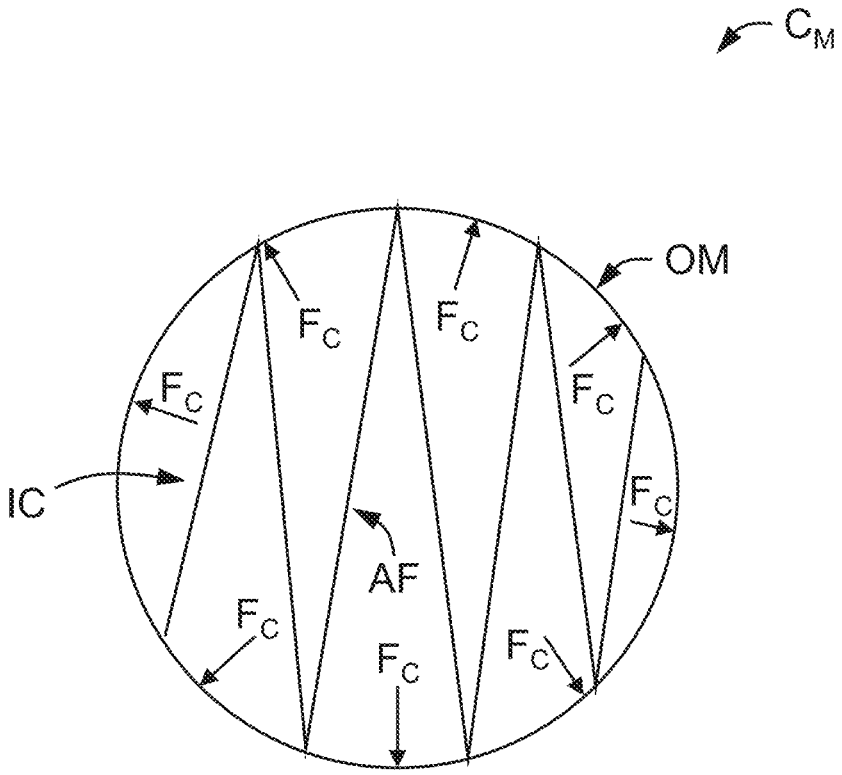
FIG. 7 shows a cross section of a smokable item according to exemplary embodiments hereof.

FIG. 7 shows a cross-section of an exemplary cone mouthpiece $C_M$ taken from a perspective of the cutlines I-I of FIG. 6. As shown, a cone mouthpiece $C_M$ may typically include an outer layer of material OM wrapped around an inner core IC that provides strength and rigidity to the mouthpiece $C_M$. Oftentimes, a cone mouthpiece $C_M$ may be formed by providing a section of material such as paper or cardboard, rolling the section into a conical frustum, and providing an inner core IC within the rolled conical frustum. In some cases, the inner core IC may be formed by folding a first portion of the section of material into an accordion fold arrangement, and then wrapping a remaining portion of the section around the accordion folded portion to form the mouthpiece $C_M$. This results in a cone mouthpiece $C_M$ with an outer layer of material OM encircling an inner core portion IC comprising an accordion-folded portion AF of material as shown in FIG. 7. In this way, the inner accordion folds AF may provide rigidity and strength to the outer layer of material OM by applying outward forces Fc to the outer layer OM to prevent the outer layer OM from collapsing during use (e.g., when the user presses the mouthpiece between his/her lips or teeth). This arrangement also allows smoke to pass through the mouthpiece $C_M$ by moving between the adjacent accordion folds AF.

In addition, other cone mouthpieces $C_M$ may achieve a similar robust structure by providing a spiral folded portion instead of or in addition to the accordion folded portion AF. Other types of folds, such as partitions, also may be provided. In addition, an inner core IC may not necessarily be required, and the outer layer of material OM rolled into a tubular and/or frustum shaped mouthpiece may provide adequate rigidity by itself. Also, other materials may be included within the mouthpiece $C_M$, such as cellulose, cotton, other fibrous materials, foam, fabric, and/or other suitable materials to provide inner support to the mouthpiece. These materials also may provide filtering. Additionally, for smokable rods that may not include a mouthpiece (e.g., hand-rolled joints or cigarettes), the smokable materials within the smokable rod in the area of its mouth end also may provide similar inner support and rigidity. In any event, it is understood that the cone mouthpiece $C_M$ (and/or the mouth end of a smokable rod without a mouthpiece) may include an inner core portion IC that may provide stiffness, rigidity, and overall strength to the mouthpiece $C_M$. As such, when the mouthpiece $C_M$ is squeezed, the mouthpiece $C_M$ may be resilient and may resist the compression such the mouthpiece $C_M$ may press back by exerting outward forces Fc to its outer layer OM such that the mouthpiece $C_M$ may not significantly collapse or crimp inward during normal use. As will be described in other sections, the current invention may capitalize on this structure of the mouthpiece $C_M$ to perform its functionalities.

In some embodiments, the passageway's inner circumferential sidewalls 44 may have a circular cross-section from the perspective of looking into the passageway 20 directly through the first opening 21 and/or directly through the second opening 22. However, other shaped cross-sections also are contemplated.

In some embodiments, as shown in FIGS. 6, the passageway 20 may include a diameter that varies between the first end opening 21 and the second end opening 22. For example, in some embodiments, the diameter D7 of the first opening 21 may be larger than the diameter D8 of the second opening 22 such that the passageway 20 may include a diameter that tapers (e.g., linearly or non-linearly) inward between the first and second openings 21, 22. In some embodiments, as shown in FIG. 6, the diameter of the passageway 20 may taper linearly from the first opening 21 to the second opening 22 thereby forming a conical frustum shaped passageway 20. As described in other sections, in some embodiments, the diameter also may vary non-linearly between the first and second openings 21, 22.

As shown in FIG. 6, the inner passageway 20 may taper inward from its upper opening 21 to its lower opening 22 at a passageway inner sidewall angle $\theta_P$ with respect to the vertical axis.

Figure 8:
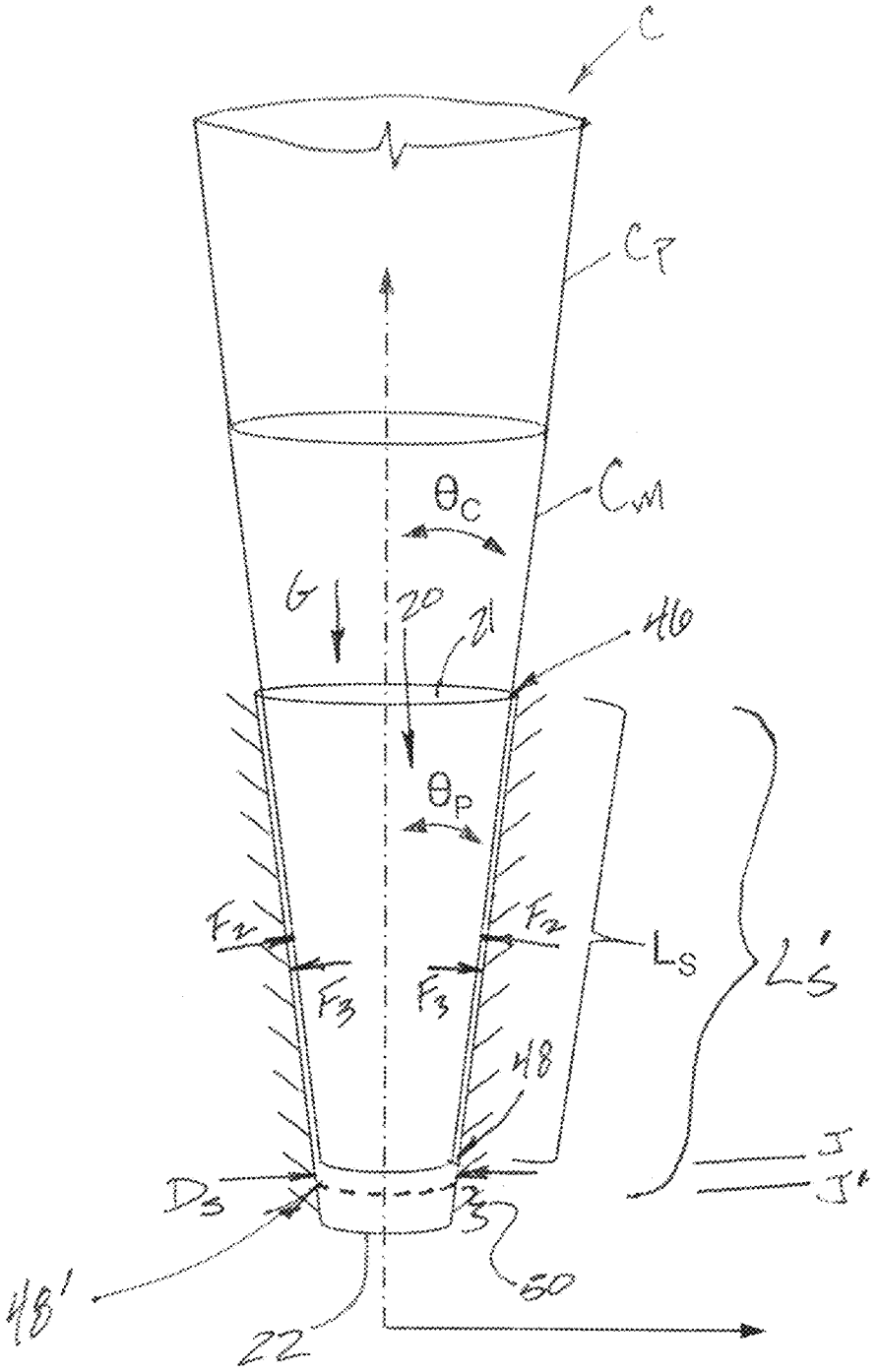
FIGS. 8-12 show aspects of a holder device passageway configured with a smokable item according to exemplary embodiments hereof.

FIG. 8 shows the cone mouthpiece $C_M$ of FIGS. 6 and 7 received into the inner passageway 20 of FIG. 6. For demonstration, the passageway inner sidewall angle $\theta_P$ and the cone outer sidewall angle $\theta_C$ are depicted as generally matching. However, as described in other sections, it is understood that this may not necessarily be the case.

As shown in FIG. 8, when the cone mouthpiece $C_M$ is received into the passageway 20 by moving the mouthpiece $C_M$ downward in the direction of the arrow G (FIG. 6) the mouthpiece $C_M$ may initially extend into the passageway 20 an initial depth J. This may result in an initial uppermost point of contact 46 between the passageway's inner sidewalls 44 and the mouthpiece's outer sidewalls $C_S$ and an initial lowermost point of contact 48 between the same. This also may result in an initial section of circumferential surface area contact $L_S$ between the passageway 20 and the cone C from the uppermost to the lowermost points of contact 46, 48. In this example, because Op generally matches $\theta_C$, the section of surface area contact $L_S$ may be generally linear such that the passageway's inner sidewalls 44 and the cone's outer sidewalls $C_S$ may rest against one another flush from the first contact point 46 to the second contact point 48. At this initial depth J, the cone C may generally rest within the upper portion of the passageway 20.

In some embodiments, because it may be preferable that the cone mouthpiece $C_M$ is held securely within the passageway 20 during its use, the mouthpiece $C_M$ may be pressed further downward from its initial depth J (where the passageway sidewalls 44 generally rest against the cone's sidewalls $C_S$) to a compressed depth J' (where the passageway sidewalls 44, being wedge-shaped, press inward on the mouthpiece sidewalls $C_S$ thereby causing the mouthpiece $C_M$ to compress slightly inward). This may cause the lowermost point of contact 48 to move downward from its initial position to a compressed position (notated in FIG. 8 as 48').

In some embodiments, this additional downward movement of the mouthpiece $C_M$ in the direction of the arrow G may cause the tapered passageway sidewalls 44, being wedge shaped and rigid (e.g., comprising hard candy), to apply an inward force F2 to the mouthpiece $C_M$ (e.g., to the mouthpiece's outer circumferential sidewalls $C_S$) thereby causing the mouthpiece $C_M$ to slightly compress inward. However, because the mouthpiece may include a suitable rigidity (e.g., an inner core IC comprising an accordion fold as described with reference to FIG. 7 above and/or a sufficiently rigid outer layer of material OM), the mouthpiece $C_M$ may resist the compression and may apply an outward counter force F3 to the passageway sidewalls 44 (generally opposite the force F2). The opposing forces F2, F3 may securely hold the mouthpiece $C_M$ within the passageway 20 until it is deliberately removed therefrom. In addition, the opposing forces F2, F3 also may set up a frictional force between the surfaces 44, $C_S$ that may further secure the mouthpiece $C_M$ within the passageway. In some embodiments, it may be preferable for the user to slightly rotate the mouthpiece $C_M$ (e.g., a quarter-turn) when pressing the mouthpiece $C_M$ downward to the compressed position to facilitate its movement. To remove the cone mouthpiece $C_M$ from the passageway 20, the user may simply grasp the mouthpiece $C_M$ and pull it out of the passageway 20 through the top opening 21 by exerting an adequate upward force to overcome the forces F2, F3.

In some embodiments, the inventor has discovered that a downward movement from the initial depth J to the compressed depth J' of about 0.25 mm to about 4 mm, and preferably of about 0.5 mm to about 3.0 mm, and more preferably of about 1.0 mm provides an adequate combination of forces F2, F3 to hold the cone mouthpiece $C_M$ securely within the passageway 20 during use.

In some embodiments, as shown in FIG. 8, the lowermost point of contact 48' with the cone mouthpiece $C_M$ in the compressed position is preferably positioned above the passageway's second opening 22 thereby forming a gap 50 between the point of contact 48' and the opening 22. This gap 50 may be chosen to provide sufficient separation between the lower end $C_L$ of the cone mouthpiece $C_M$ and the lower opening 22 of the holder body 12 to provide additional space within the passageway 20 such that cone mouthpieces $C_M$ of varying diameters may fit snug within the passageway 20 (i.e., smaller diameter cones C may extend deeper into the passageway 20 than larger diameter cones C, and the gap 50 may provide this additional downward space for such).

In some embodiments, the gap 50 is formed by providing a stop to the cone mouthpiece's lower end $C_L$ at the lower point of contact 48'. This stop may be provided by the inner diameter of the passageway 22 at a location just below the lower point of contact 48' being smaller than the diameter of the compressed lower end $C_L$ of the mouthpiece $C_M$. That is, as the mouthpiece $C_M$ is moved from its initial depth J to its compressed depth J', the diameter D10 of the mouthpiece's lower end $C_L$ may reduce slightly due to the compression of the lower end $C_L$. However, because the mouthpiece $C_M$ may include the inner core accordion folds AF as described above, the lower end $C_L$ may resist further compression such that the mouthpiece $C_M$ instead becomes snugly lodged within the passageway 20 at the point 48'. In this arrangement, the diameter of the passageway 22 just below the point 48' may be smaller than the compressed lower end's diameter such that the lower end $C_L$ cannot be moved further downward without excessive force. As such, the narrower diameter just below the compressed lower point of contact 48' provides a stop to the cone mouthpiece $C_M$.

Given the above and given the linear passageway sidewalls 44 in this example, the diameters D7 and D8 of the passageway 22 may be specifically chosen to provide a stop diameter Ds at a location immediately below the compressed point of contact 48', with the stop diameter Ds being slightly less than the diameter of the compressed lower end $C_L$ of the cone mouthpiece $C_M$ in this arrangement. Preferred values of the diameters D7, D8, and Ds will be described in other sections. In some embodiments, the stop diameter Ds also may be provided by a protrusion extending inward from the holder body 12 inner sidewalls 44, e.g., a circumferential ridge or point projection, etc.). In other embodiments, the stop may be provided by the upper point of contact 46, e.g., at the upper opening 21 and set by its corresponding diameter D7. This will be described in other sections.

In some embodiments, when the mouthpiece $C_M$ is moved from its initial depth J to its compressed depth J', the initial section of surface area contact $L_S$ between the passageway 20 and the cone C from the uppermost to the lowermost points of contact 46, 48 may transition to a compressed surface area contact $L_S'$ that may be slightly larger than the initial section of surface area contact $L_S$ because of the additional downward movement of the mouthpiece $C_M$. In some embodiments, the diameters D7, D8, and Ds may be specifically chosen to provide an adequate amount of compressed surface area contact $L_S'$ to provide an adequate magnitude of forces (e.g., forces F2 and F3) to adequately hold the cone mouthpiece $C_M$ within the passageway 20 when in use.

In some embodiments, the inventor has discovered that it may be preferable for the passageway's upper diameter D7 to be about 4 mm to about 8 mm, and more preferably about 5 mm to about 7 mm, and more preferably about 5 mm to about 6 mm given the typical diameters D9, D10 of a typical cone mouthpiece $C_M$. In addition, because a typical cone mouthpiece $C_M$ may be about 26 mm in length, it may be preferable for the passageway 20 (and the holder body 12) to be about 15 mm to about 20 mm so that an adequate portion of the cone mouthpiece $C_M$ is held within the passageway 20 for use. Given these dimensions, in some embodiments, the passageway inner sidewall angle $\theta_P$ may preferably be about 0.1° to about 12°, and more preferably about 1° to about 10°, and more preferably about 2° to about 7°, and more preferably about 3° to about 6°, and more preferably about 4° to about 5°, and more preferably about 4.4°.

Figure 9:
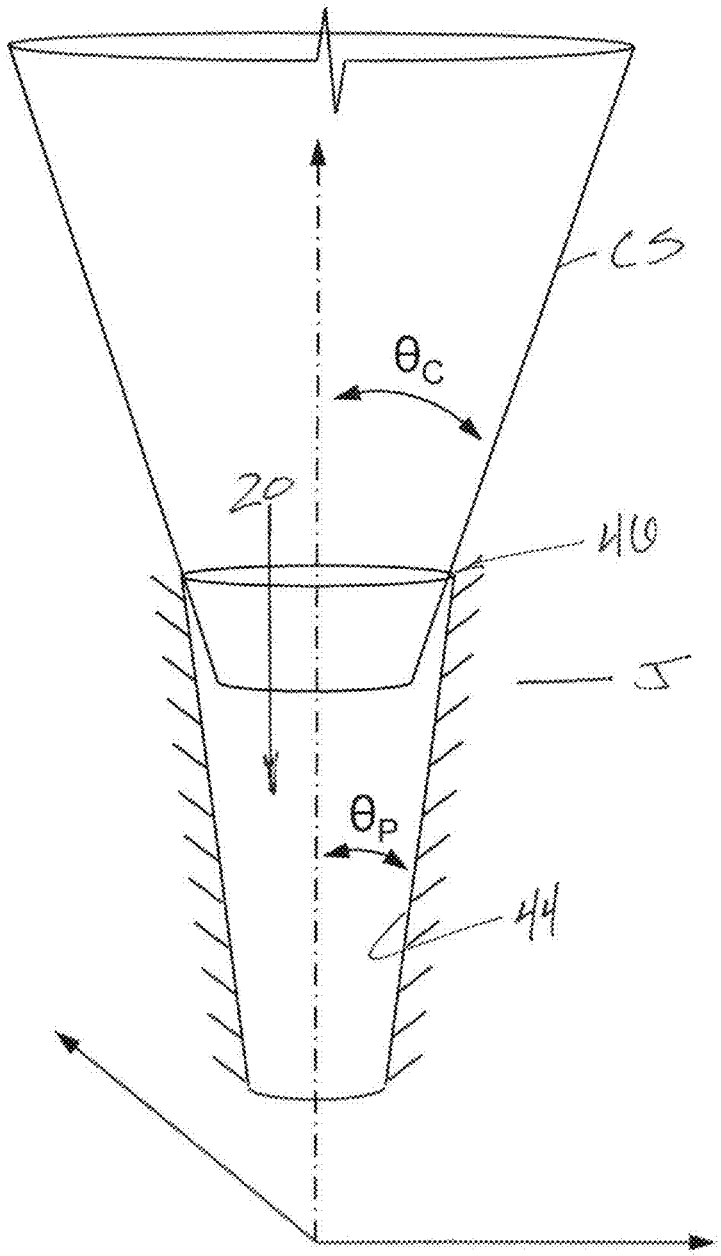

FIG. 9 shows a scenario where the cone outer sidewall angle $\theta_C$ is greater than the passageway inner sidewall angle $\theta_P$, and the mouthpiece $C_M$ is inserted into the upper opening 21 of the passageway 20 to its initial depth J. In this case, there may be a single point of contact 46 between the mouthpiece sidewalls $C_S$ and the passageway 20 located generally at the passageway's top opening 21.

Figure 10:
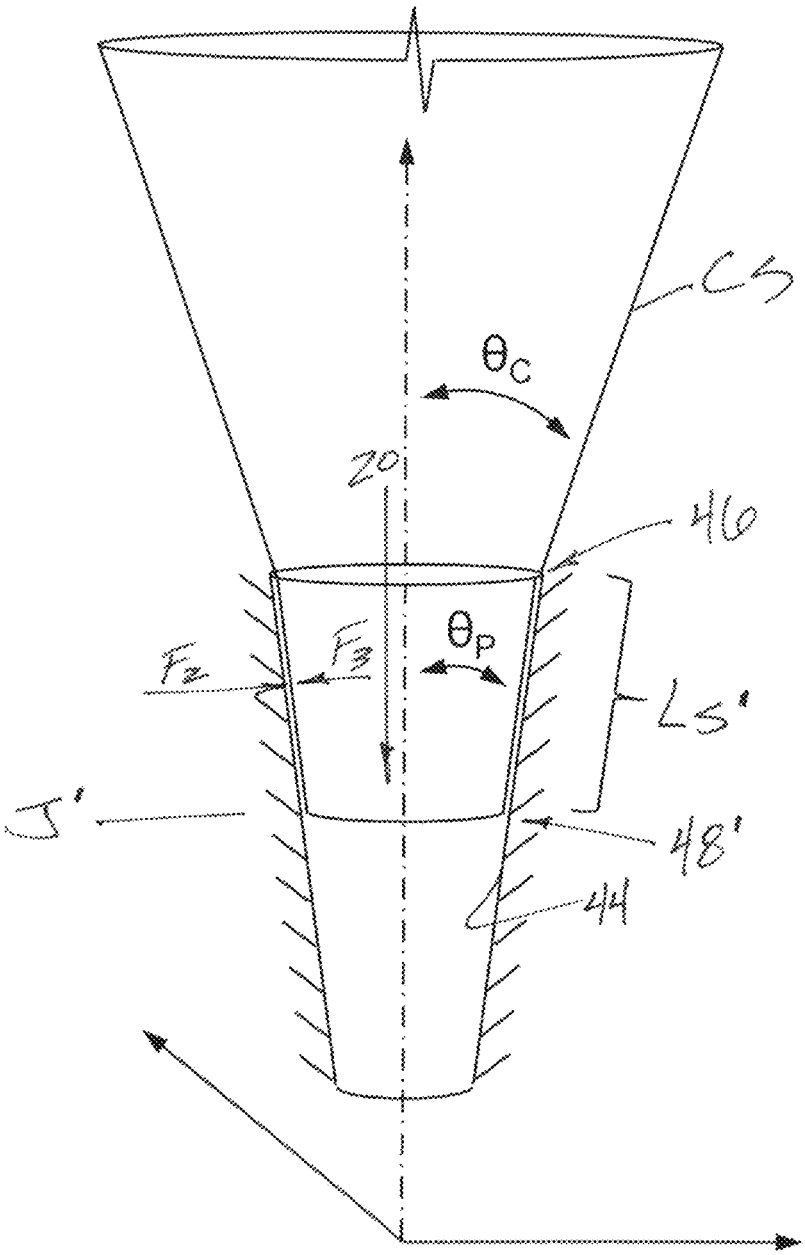

In some embodiments, as shown in FIG. 10, when the mouthpiece $C_M$ is pressed deeper into the passageway 20 to its compressed depth J', the mouthpiece's outer sidewalls $C_S$ may compress inward slightly such that at least a portion of the sidewalls $C_S$ are flush against the passageway sidewalls 44 thereby forming a compressed surface area contact $L_S'$ between the sidewalls 44, $C_S$ from the upper point of contact 46 to a compressed lower point of contact 48'. In this arrangement, the upper point of contact 46 may generally remain at the passageway's top opening 21. Given the above, in some embodiments, the forces F2, F3 may be applied between the sidewalls 44, $C_S$ as described above to hold the mouthpiece $C_M$ in place during use. As with other embodiments, the diameters D7, D8, and Ds in this arrangement may be specifically chosen to provide an adequate amount of compressed surface area contact $L_S'$ to provide an adequate magnitude of forces (e.g., forces F2 and F3) and friction to adequately hold the cone mouthpiece $C_M$ within the passageway 20 when in use.

In some embodiments, the functionalities of the embodiment of FIG. 9 also may be applicable to the embodiment(s) wherein the upper and lower diameters D7, D8 of the passageway 20 may be generally equal such that its passageway inner sidewall angle $\theta_P$ may be generally zero (which therefore may be less than the cone mouthpiece's outer sidewall angle $\theta_C$ which may be non-zero). As such, when the mouthpiece $C_M$ is inserted into the upper opening 21 of the passageway 20 to its initial depth J, there may be a single point of contact 46 between the mouthpiece sidewalls $C_S$ and the passageway 20 located generally at the passageway's top opening 21. Then, when the mouthpiece $C_M$ is pressed deeper into the passageway 20 to its compressed depth J', the mouthpiece's outer sidewalls $C_S$ may compress inward slightly such that at least a portion of the sidewalls $C_S$ are flush against the passageway sidewalls 44 thereby forming a compressed surface area contact $L_S'$ between the sidewalls 44, $C_S$ from the upper point of contact 46 to a compressed lower point of contact 48'. In this arrangement, the upper point of contact 46 may generally remain at the passageway's top opening 21. Given the above, the forces F2, F3 may be applied between the sidewalls 44, $C_S$ as described herein to hold the mouthpiece $C_M$ in place during use.

In addition, in some embodiments, in the arrangement wherein the upper and lower diameters D7, D8 of the passageway 20 may be generally equal, the stop that may prevent the cone mouthpiece $C_M$ from moving further downward from its compressed depth J' may be provided by the first point of contact 46 at the top opening 21 with diameter D7. That is, the diameter D7 may be chosen such that when the cone mouthpiece $C_M$ is pressed downward to its compressed depth J', the diameter D7 causes the cone mouthpiece $C_M$ to slightly compress and to create a compressed surface area contact $L_S'$ between the passageway's inner sidewalls 44 and the cone mouthpiece $C_M$ extending from the first point of contact 46 to slightly below the first point of contact 46. As such, the diameter D7 may be specifically chosen to allow a lower portion of the cone mouthpiece $C_M$ to extend into the passageway 20 before fitting snug and then being compressed by the diameter D7 at its compressed depth J'. The diameter D7 is chosen such that once the cone mouthpiece $C_M$ is at its compressed depth J', that no further downward movement of the cone mouthpiece $C_M$ into the passageway 20 is possible without applying excessive force.

Figure 11:
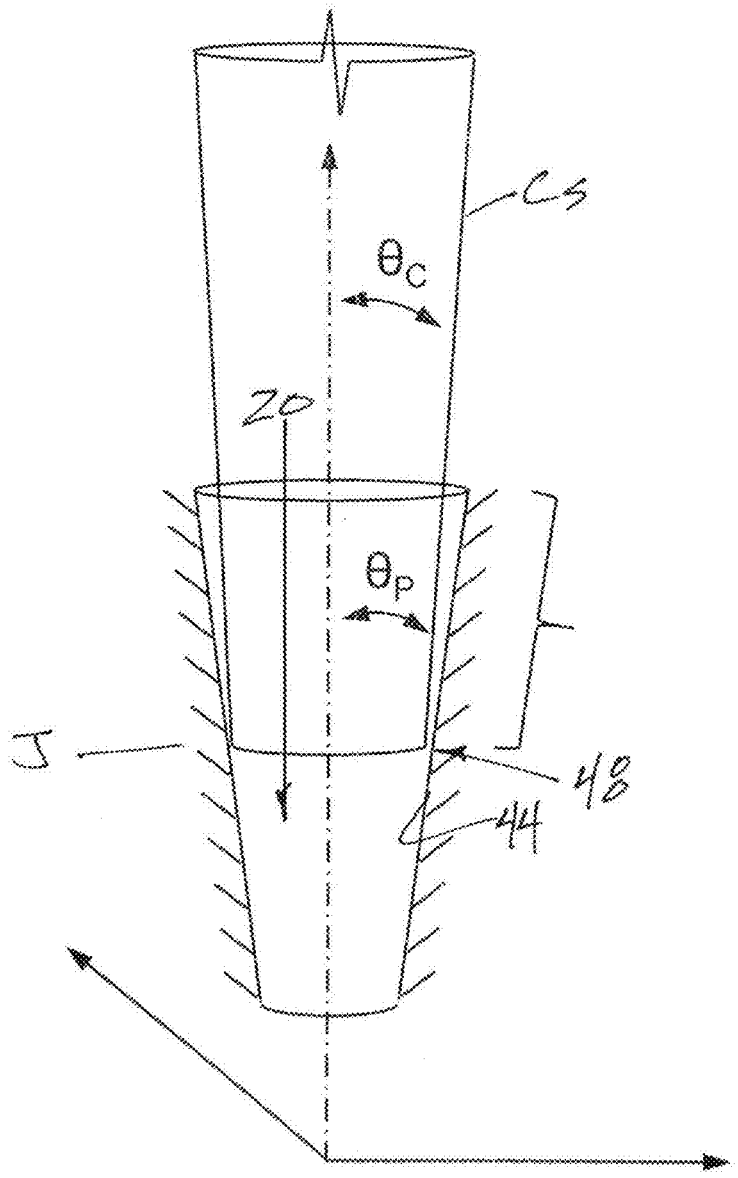

FIG. 11 shows a scenario where the cone outer sidewall angle $\theta_C$ is less than the passageway inner sidewall angle $\theta_P$, and the mouthpiece $C_M$ is inserted into the upper opening 21 of the passageway 20 to its initial depth J. In this case, there may be a single point of contact 48 (the lower point of contact) between the mouthpiece sidewalls $C_S$ and the passageway 20. In this scenario, in some embodiments, the cone outer sidewall angle $\theta_C$ may be zero (e.g., as with a cigarette) or non-zero (e.g., as with a cone mouthpiece).

Figure 12:
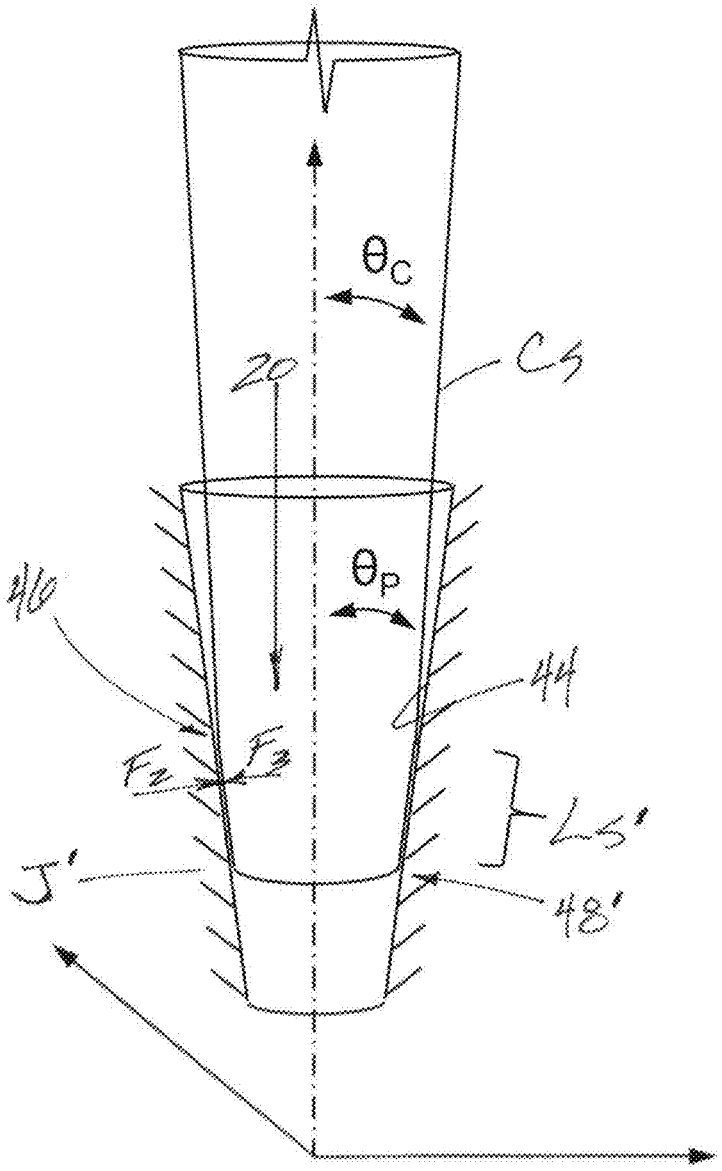

In some embodiments, as shown in FIG. 12, when the mouthpiece $C_M$ is pressed deeper into the passageway 20 to its compressed depth J', the mouthpiece's outer sidewalls $C_S$ may compress inward slightly such that at least a portion of the sidewalls $C_S$ are flush against the passageway sidewalls 44 thereby forming a compressed surface area contact $L_S'$ between the sidewalls 44, $C_S$ from the upper point of contact 46 to a compressed lower point of contact 48'. Given the above, in some embodiments, the forces F2, F3 may be applied between the sidewalls 44, $C_S$ as described above to hold the mouthpiece $C_M$ in place during use. As with other embodiments, the diameters D7, D8, and Ds in this arrangement may be specifically chosen to provide an adequate amount of compressed surface area contact $L_S'$ to provide an adequate magnitude of forces (e.g., forces F2 and F3) and friction to adequately hold the cone mouthpiece $C_M$ within the passageway 20 when in use.

In any of the embodiments described herein, it may be preferable that the upper opening 21 include a diameter D7 that is equal to or greater than the diameter D10 of the lower end $C_L$ of the cone mouthpiece $C_M$. In this way, at least a portion of the mouthpiece's lower end $C_L$ may be inserted into the passageway's upper opening 21 to be slightly compressed and held within the passageway 20 as describe herein.

Figure 13:
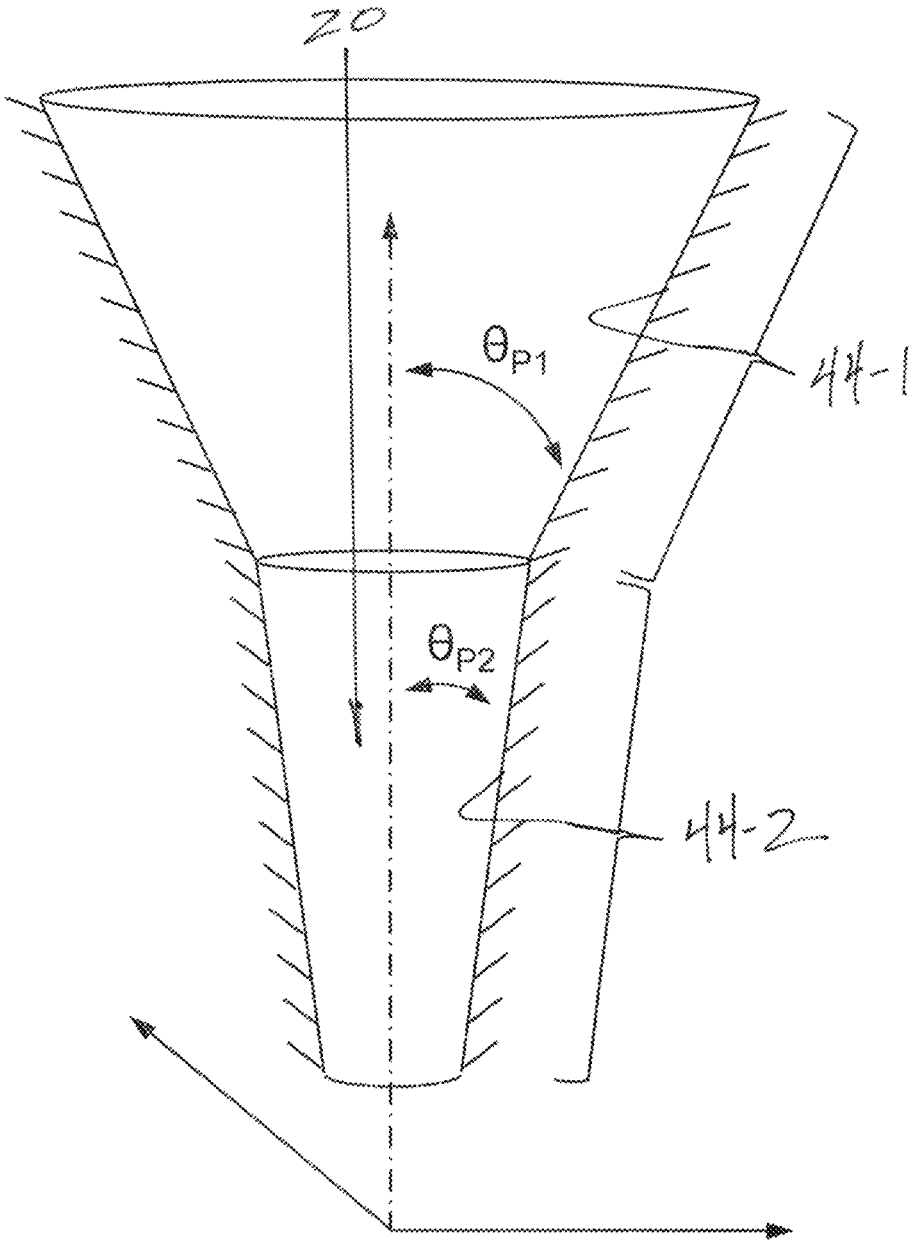
FIGS. 13-14 show aspects of a holder device passageway according to exemplary embodiments hereof.

FIG. 13 shows a passageway 20 including inner sidewalls 44 that extend nonlinearly from the upper opening 21 to the lower opening 22. As shown, in some embodiments, a first sidewall portion 44-1 may extend downward from the upper opening 21 at a first sidewall angle θP1 to a first location between the upper and lower openings 21, 22, and a second sidewall portion 44-2 may extend downward from the first location at a second sidewall angle θP2 to the lower opening 22. In some embodiments, the first sidewall angle θP1 may be greater than or equal to the second sidewall angle θP2. This arrangement may enable a cone mouthpiece $C_M$ with a wider lower end diameter D10 to fit into the upper portion of the passageway 20 to be compressed and held secure by the first sidewall portion 44-1, and (at a different moment of time) a second cone mouthpiece $C_M$ with a smaller lower end diameter D10 to be compressed and held secure by the second sidewall portion 44-2.

In some embodiments, it may be preferable that the transition between the first sidewall portion 44-1 to the second sidewall portion 44-1 by smooth and curved such that mouthpieces $C_M$ with smaller diameter D10 may move (e.g., slide) past the transition area to be received by the lower sidewall portion 44-1 without being obstructed or jammed. In some embodiments, the passageway's inner sidewalls 44 may extend from an upper location (e.g., at the top opening 21) to a lower location (e.g., to the lower opening 22) following a smooth concave curvature (e.g., parabolic, etc.).

Figure 14:
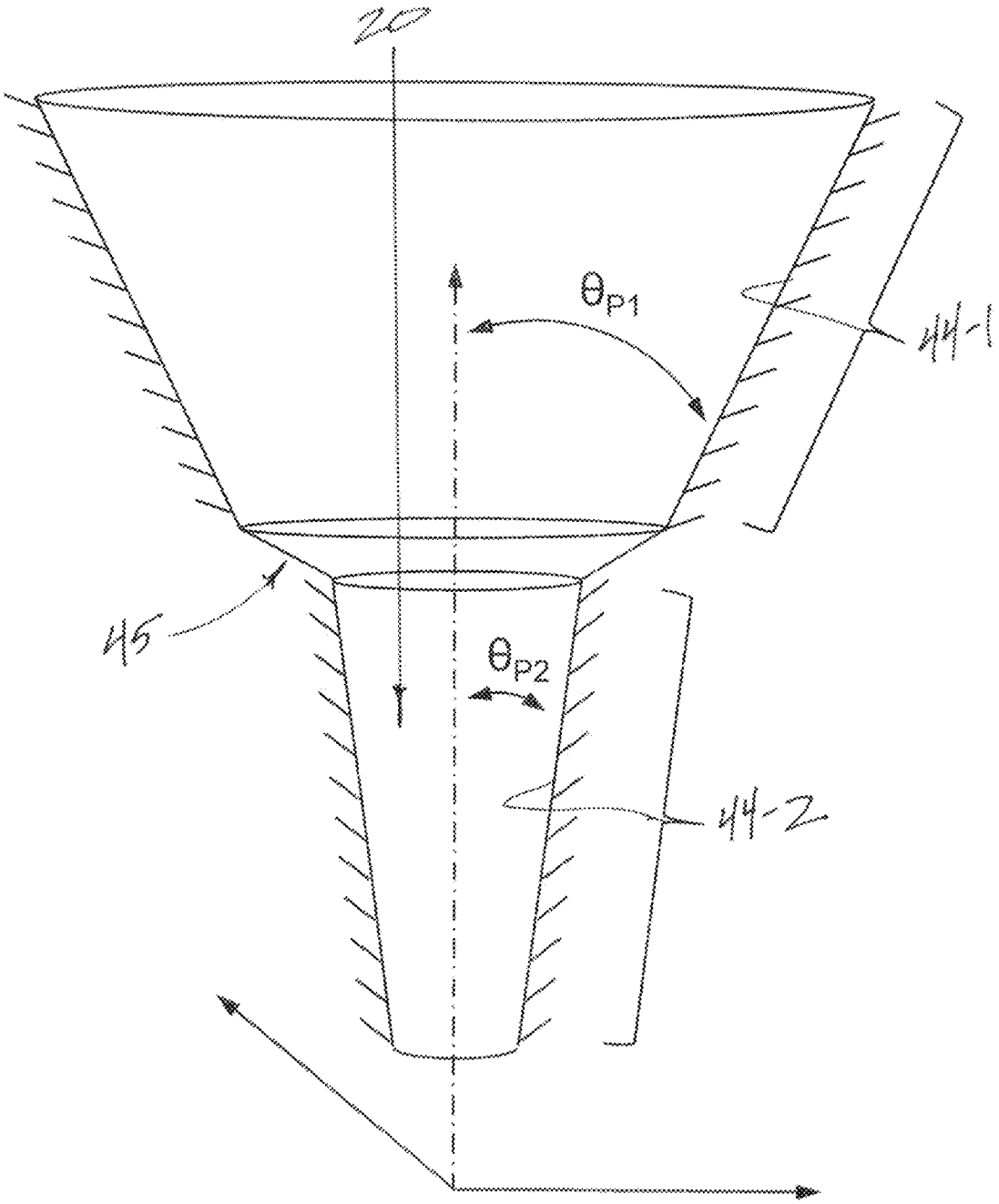

In other embodiments, as shown in FIG. 14, the transition between the first sidewall portion 44-1 and the second sidewall portion 44-2 may include a linear step 45. In this case, although not necessarily required, it may be preferable that the linear step be angled downward to enable a smaller diameter mouthpiece to slide through the step's transition portion without becoming jammed. The step also may be smoothed (e.g., the corners may be rounded) and/or formed by a first concave curvature followed by a second convex curvature.

Two-Point Hold

Figure 15:
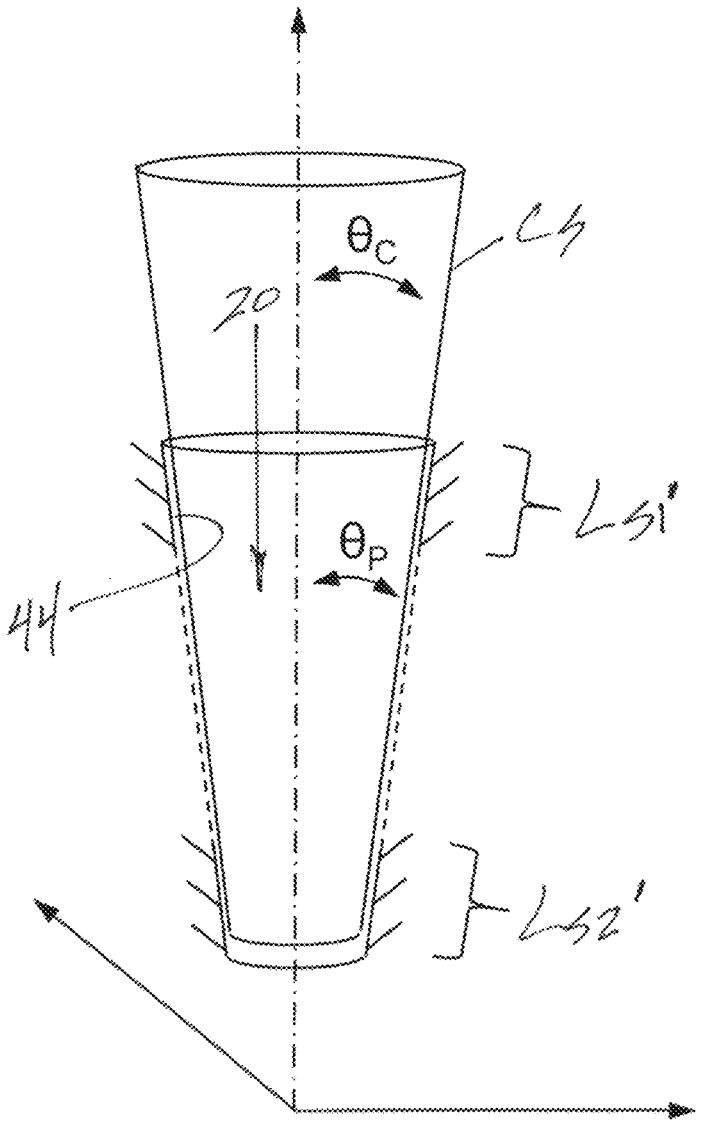
FIGS. 15-19 show aspects of a holder device passageway configured with a smokable item according to exemplary embodiments hereof.

In some embodiments, the inventor has discovered, that depending on the dimensions of the cone mouthpiece $C_M$ and of the passageway 20, and the stiffness of the cone mouthpiece's outer sidewalls $C_S$ (e.g., provided by the mouthpiece's inner core IC), the cone mouthpiece $C_M$ may be adequately held secure within the passageway 20 by the first and second points of contact 46, 48. For example, as shown in FIG. 15, the first point of contact 26 may provide a first compressed surface area contact $L_{S1}'$ and the second compressed point of contact 48' may provide a second compressed surface area contact $L_{S2}'$, with the first and second compressed surface area contact $L_{S1}'$, $L_{S2}'$ providing adequate inward forces F2 to the mouthpiece $C_M$ and receiving adequate outward forces F3 from the mouthpiece $C_M$ to adequately hold the mouthpiece $C_M$ within the passageway 20. This may be referred to as a two-point holding scheme wherein the first holding point may be the first point of contact 46 and its resulting first compressed surface area contact $L_{S1}'$ and the second holding point may be the second point of contact 48' and its resulting second compressed surface area contact $L_{S2}'$. This may be analogous to how two points in space may define a line such that the first and second points of contact 46, 48' may be in-line with the mouthpiece sidewalls $C_S$ as the mouthpiece $C_M$ is pressed downward into its compressed depth J', and as such, the first and second points of contact 46, 48' may provide scaffolding to the mouthpiece $C_M$ so that the mouthpiece $C_M$ may not move laterally and/or pivot side-to-side within the passageway 20. The first and second points of contact 46, 48' thereby may provide the forces F2 to the mouthpiece $C_M$ to hold it in place.

Figure 16:
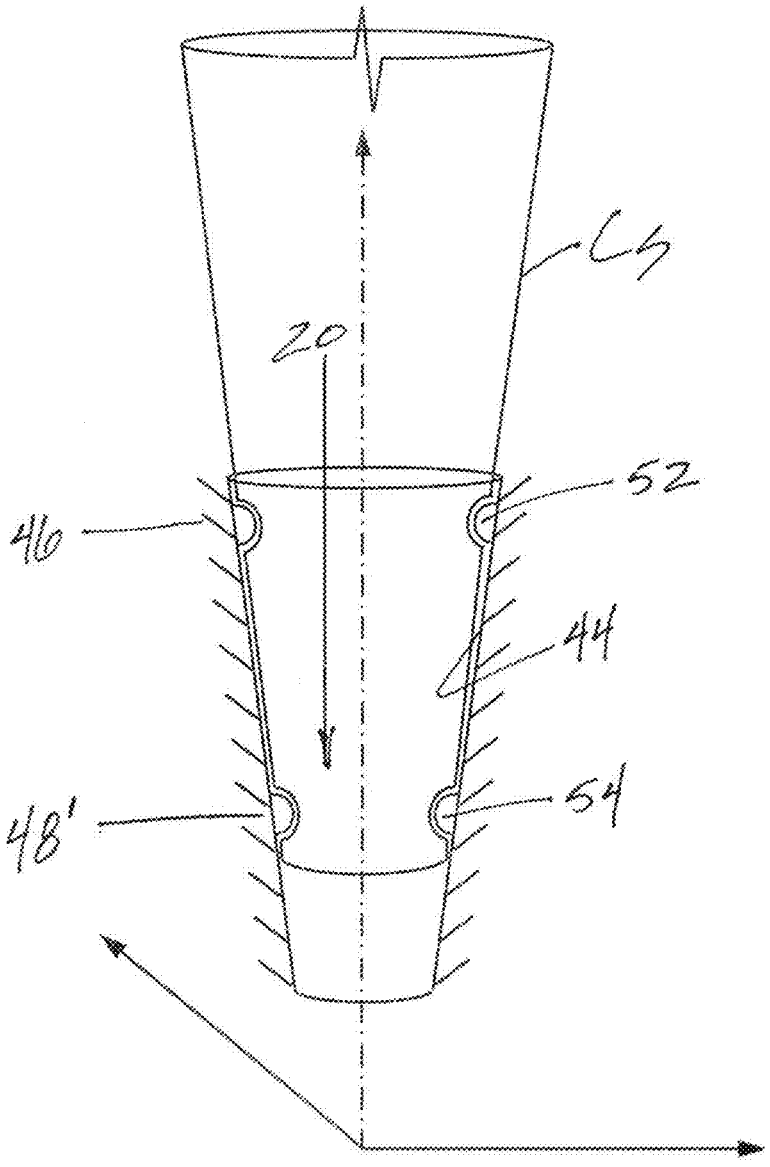

In the drawing of FIG. 15, the portions of the inner passageway sidewalls 44 between the first compressed surface area contact $L_{S1}'$ and the second compressed surface area contact $L_{S2}'$ are depicted as dashed lines to indicate that these sidewall areas may not necessarily need to make contact with the outer sidewalls $C_S$ of the cone mouthpiece $C_M$ and as such, may be formed in other shapes for forms. In a first example of this, as shown in FIG. 16, the passageway sidewalls 44 may include a first sidewall protrusion 52 (e.g., a first circumferential ridge or one or more point protrusion(s)) positioned to provide the first point of contact 46 and a second sidewall protrusion 54 (e.g., a second circumferential ridge or one or more point protrusion(s)) positioned to provide the compressed second point of contact 48'. Accordingly, the first sidewall protrusion 52 may form and provide a first compressed surface area contact $L_{S1}'$ (e.g., at the protrusion 52 and/or on either side of the protrusion 52) and the second sidewall protrusion 54 may form and provide a second compressed surface area contact $L_{S2}'$ (e.g., at the protrusion 54 and/or on either side of the protrusion 54).

Figure 17:
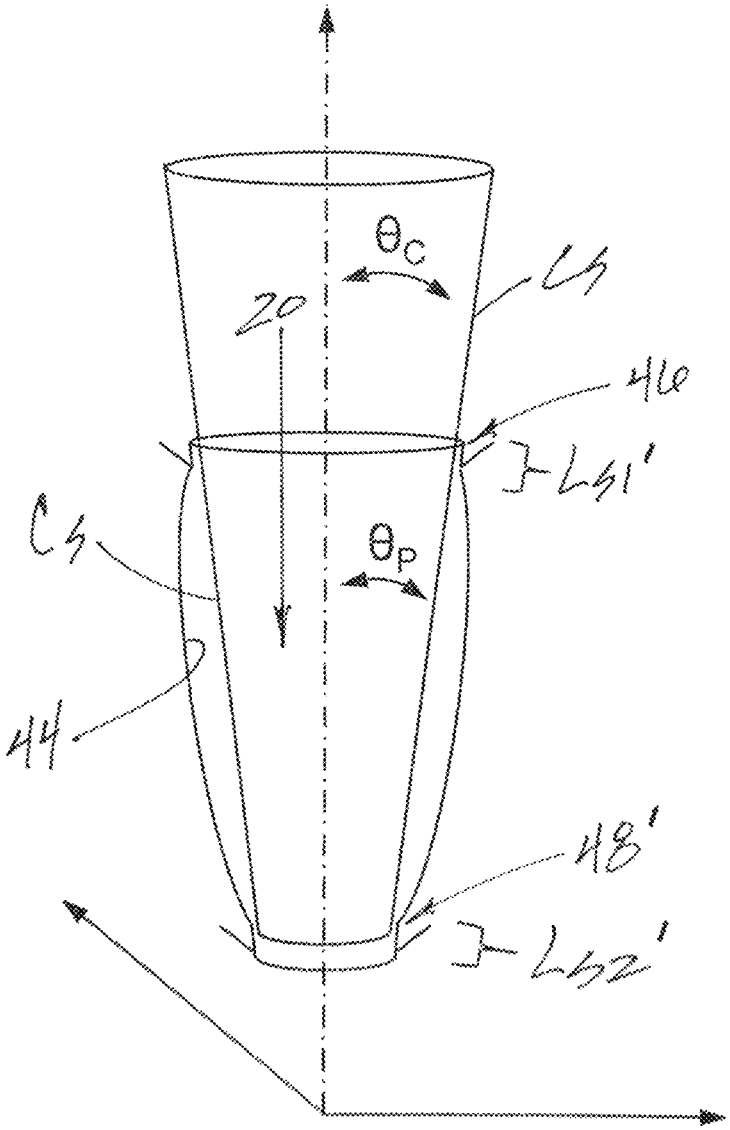

A second example of this is shown in FIG. 17 wherein, in some embodiments, the passageway's inner sidewalls 44 include a concave curvature wherein the diameter of the passageway 20 increases in the area between the first and second points of contact 46, 48'. As such, the first and second points of contact 46, 48' may provide the forces F2 and the first and second surface area contacts $L_{S1}'$, $L_{S2}'$, respectively, to hold the mouthpiece $C_M$ in place, and the portions of the passageway's inner sidewalls 44 between the points 46, 48' may be free to be formed otherwise, e.g., to include additional functionalities such as cooling, as ornamental shapes, or forms, etc.

Single-Point Hold

In some embodiments, the inventor has discovered, that depending on the dimensions of the cone mouthpiece $C_M$ and of the passageway 20, and the stiffness of the cone mouthpiece's outer sidewalls $C_S$ (e.g., provided by the mouthpiece's inner core IC), the cone mouthpiece $C_M$ may be adequately held secure within the passageway 20 by a single point of contact, e.g., by the first point of contact 46.

Figure 18:
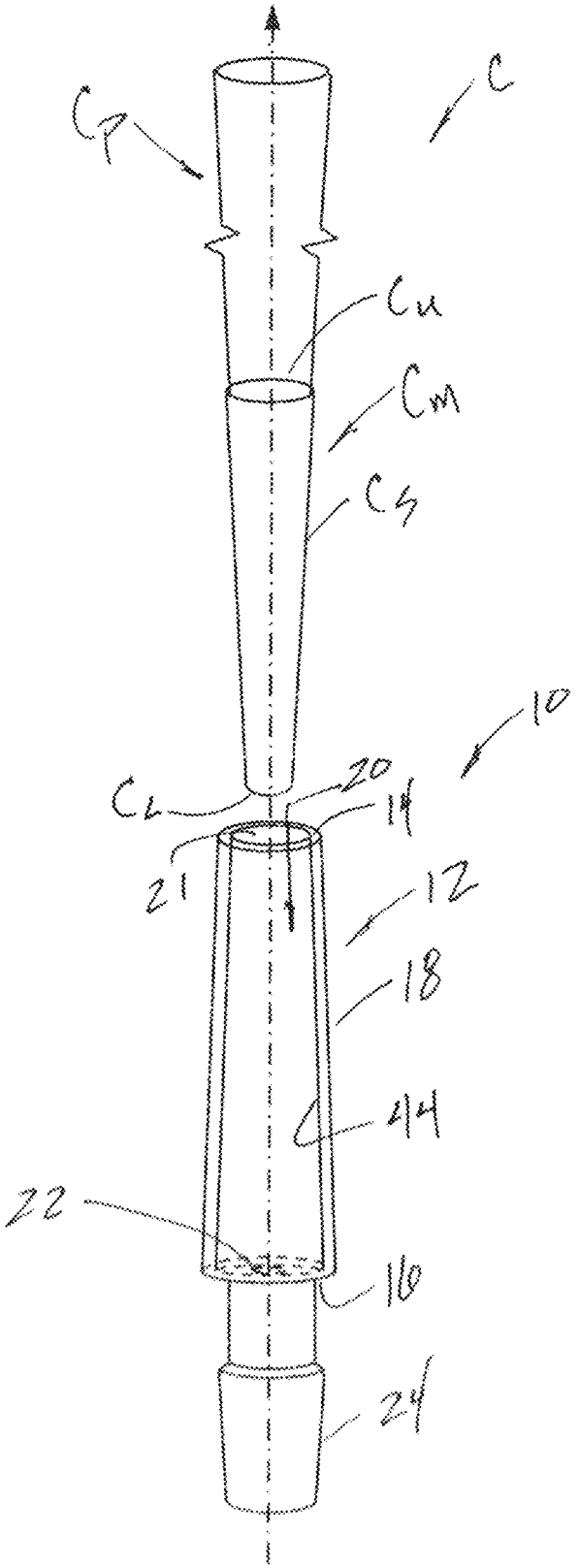
Figure 19:
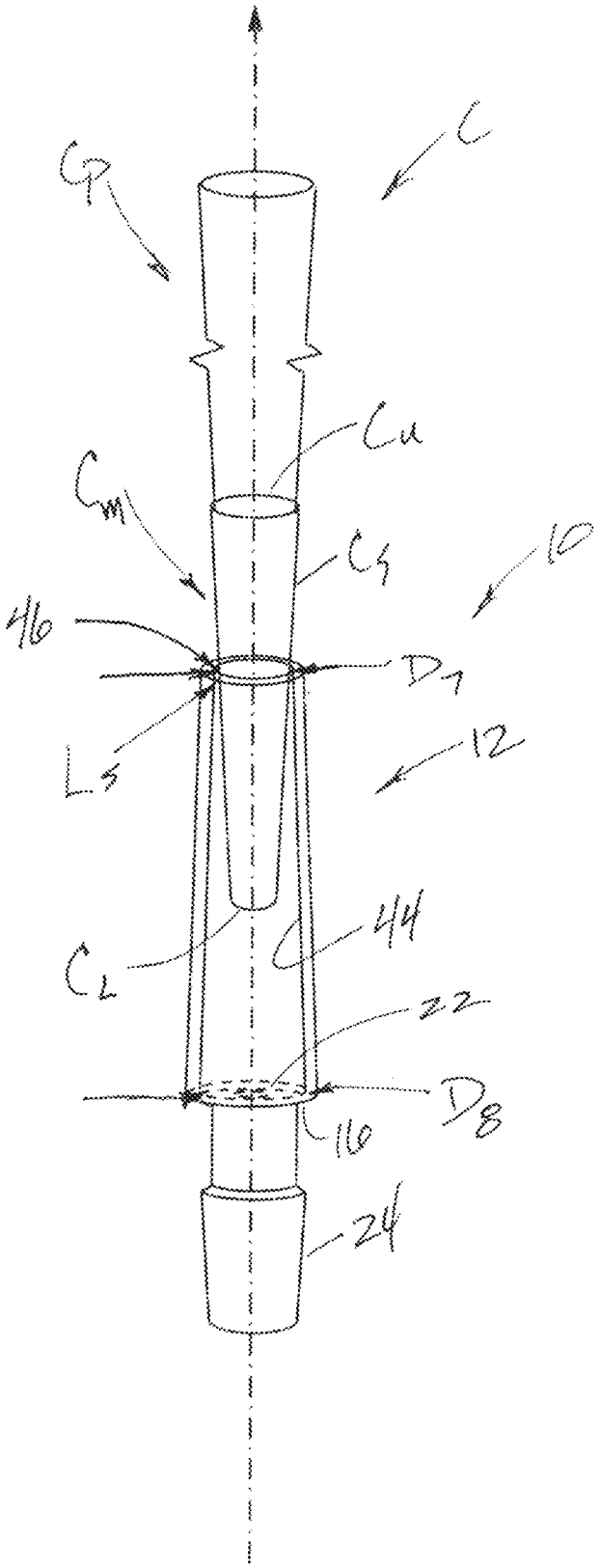

FIG. 18 shows a cone C aligned vertically with a passageway 20 wherein the passageway 20 includes an upper diameter D7 at its upper opening 21 that is less than the diameter D8' of its lower opening 22, and FIG. 19 shows the cone C inserted into the passageway 20 for use. In some embodiments, the lower end 16 of the passageway 20 may include an inward step or other type of inward transition between the inner sidewalls 44 and the lower opening 22 that may lead to the adapter 24. This transitional area may, for example, include the hollow transition portion 25 between the second end 16 and the adapter 24 described above with reference to FIG. 2. Accordingly, for this type of embodiment as shown in FIG. 19, the diameter D8' will be defined as the diameter of the passageway 20 measured between its inner sidewalls 44 at its lower end 16 (e.g., at or slightly above the inward step or transition portion 25). In some embodiments, the diameter of the lower opening 22 itself that leads to the adapter 24 may be less than the diameter D8' as it may be positioned in an interior area between the inner sidewalls 44 due to the inward step or transition.

In some embodiments, as shown in FIGS. 18 and 19, because the diameter D7 of the upper opening 21 of the passageway 20 is less than the diameter D8 of the passageway's lower end 16 (D7<D8), the passageway's inner sidewalls 44 may generally flare outwards from the upper opening 21 to the lower end 16 (e.g., as an inverted conical frustum). In some embodiments, the passageway sidewall angle $\theta_P$ may include an inward angle of about 0.1° to about 12°, and more preferably about 1° to about 10°, and more preferably about 2° to about 7°, and more preferably about 3° to about 6°, and more preferably about 4° to about 5°, and more preferably about 4.4°.

As such, when the cone mouthpiece $C_M$ is inserted into the upper opening 21 and pushed downward until snug, only the portion of the inner sidewalls 44 at the upper opening 21 defining the upper point of contact 46 may make physical contact with the sides $C_S$ of the cone mouthpiece $C_M$.

Similar to other embodiments, when the mouthpiece $C_M$ is pushed downward until snug, the first point of contact 46 causes the cone mouthpiece $C_M$ to compress slightly thereby providing a compressed surface area contact $L_{S1}$ at contact point 46. This compressed surface area contact $L_{S1}$ may provide adequate inward forces F2 to the mouthpiece $C_M$ and may receive adequate outward forces F3 from the mouthpiece $C_M$ to adequately hold the mouthpiece $C_M$ snug within the passageway 20.

In some embodiments, it may be preferable that the diameter D7 of the passageway's upper opening 21 be chosen to generally match or be slightly less than the diameter of the cone mouthpiece $C_M$ at a preferred location along the cone mouthpiece $C_M$ that may be held by the first point of contact 46. This may determine the length of the lower portion of the cone mouthpiece $C_M$ that may extend into the passageway 20 (i.e., its depth into the passageway 20). For example, it may be preferable that the diameter D7 be chosen such that about 1% to about 100% of the lower end of the cone mouthpiece $C_M$ be received into the passageway 20, and more preferably about 10% to about 100% of the lower end of the cone mouthpiece $C_M$ be received into the passageway 20, and more preferably about 25% to about 100% of the lower end of the cone mouthpiece $C_M$ be received into the passageway 20, and more preferably about 50% to about 100% of the lower end of the cone mouthpiece $C_M$ be received into the passageway 20, and more preferably about 60% to about 100% of the lower end of the cone mouthpiece $C_M$ be received into the passageway 20, and more preferably about 70% to about 100% of the lower end of the cone mouthpiece $C_M$ be received into the passageway 20, and more preferably about 80% to about 100% of the lower end of the cone mouthpiece $C_M$ be received into the passageway 20, and more preferably about 90% to about 100% of the lower end of the cone mouthpiece $C_M$ be received into the passageway 20, and more preferably about 95% to about 100% of the lower end of the cone mouthpiece $C_M$ be received into the passageway 20.

In some embodiments, it may be preferable that the diameter D8 be chosen such that the distance between the lower end $C_U$ of the cone mouthpiece $C_M$ (when inserted into the passageway 20 as described above) and the inner sidewalls 44 is small enough to prevent the cone mouthpiece $C_M$ (and the oval cone C) from pivoting side-to-side more than a few degrees (e.g., no more than about) 5°-10° within the passageway 20.

Figure 20:
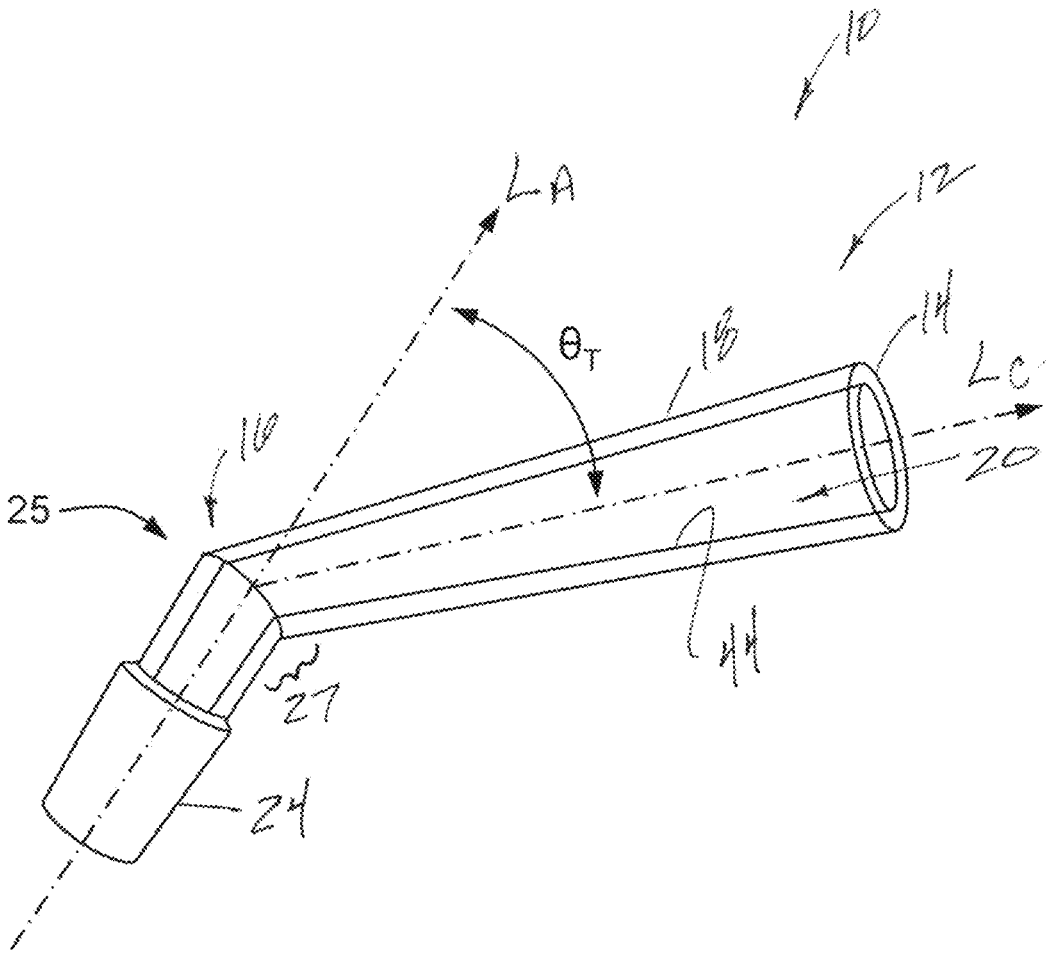
FIGS. 20-21 show aspects of a holder device and an angular transition according to exemplary embodiments hereof.
Figure 21:
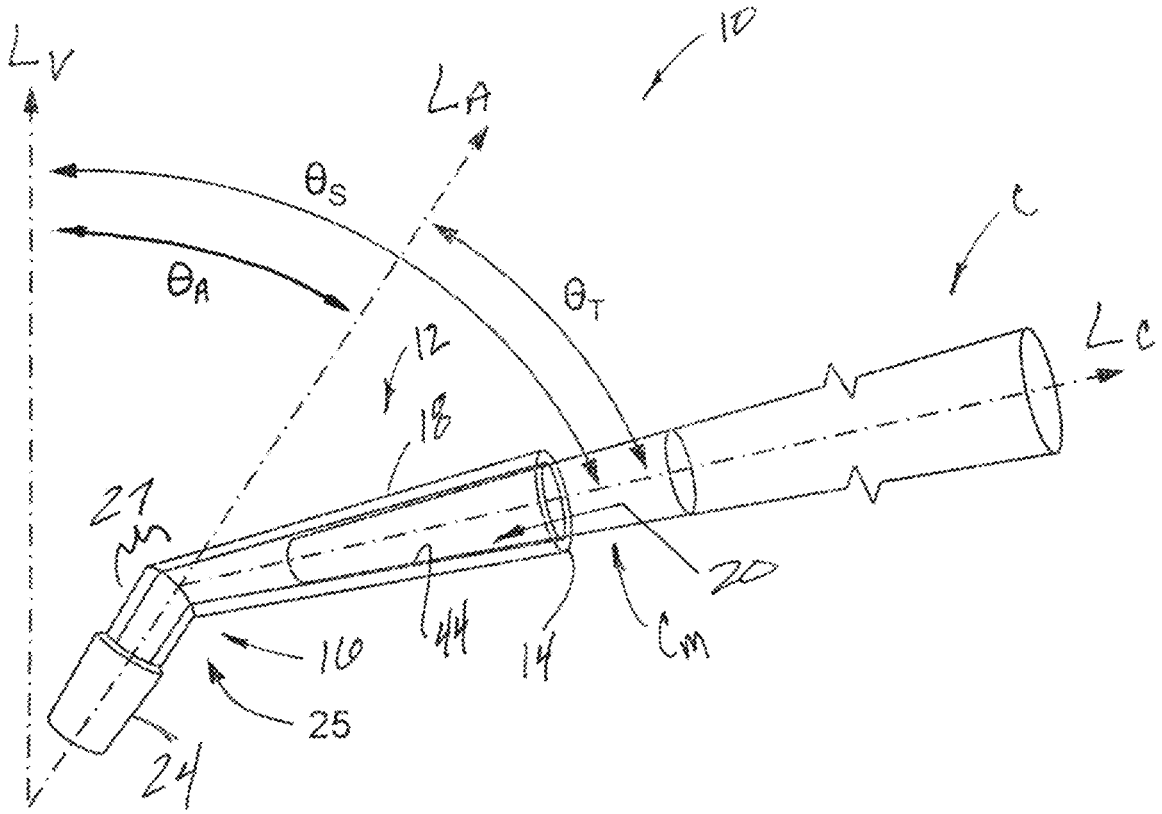

In any of the embodiments described herein, as shown in FIGS. 20 and 21, the device 10 may include an angular transition 27. In some embodiments, the angular transition 27 may be included in the device's hollow transition portion 25 between the passageway's second end 16 and the adapter 24 (also see FIG. 3). In some embodiments, the angular transition 27 may be positioned between the holder's first end 14 and second end 16. In any event, the angular transition 27 may transition the device 10 and its inner passageway 20 from a first longitudinal axis $L_A$ (e.g., the longitudinal axis of the adapter 24 and of the down stem that the adapter 24 may be coupled with during use (see FIG. 2)) to a second longitudinal axis $L_C$ (e.g., the longitudinal axis of the upper portion of the device 10 (e.g., the first end 14) wherein the cone mouthpiece $C_M$ may be received and held. In some embodiments, the angular transition 27 may translate the device 10 and its inner passageway 20 at an angle $\theta_T$. In some embodiments, the deflection angle $\theta_T$ may preferably be about 1° to about 90°, and more preferably about 10° to about 70°, and more preferably about 20° to about 60°, and more preferably about 30° to about 50°, and more preferably about 45°.

FIG. 21 shows a cone C held within the device 10. As shown, in some embodiments, the device's adapter 24 (and the down stem DS that the adapter 24 may be coupled with during use (see FIG. 2) is set at a first longitudinal axis $L_A$ offset from a vertical axis $L_V$ by an angle $\theta_A$, and the device's upper portion wherein the cone mouthpiece $C_M$ is shown received and held is set at a second longitudinal axis $L_C$ offset from the first longitudinal axis $L_A$ by an angle $\theta_T$. As such, the cone mouthpiece $C_M$ held within the passageway 20 may be positioned at an offset angle $\theta_S$ wherein $\theta_S$ equals $\theta_A+\theta_T$ ($\theta_S=\theta_A+\theta_T$). In this way, during use of the device 10, a cone C held within the device 10 may generally extend away from the waterpipe WP at an angle $\theta_S$. In some embodiments, $\theta_S$ may be about 1° to about 90°, and more preferably about 20° to about 90°, and more preferably about 30° to about 90°, and more preferably about 50° to about 90°, and more preferably about 60° to about 90°, and more preferably about 70° to about 90°, and more preferably about 75° to about 85°, and more preferably about 80°. This angular transition 27 may enable a user to light the distal end of the pre-roll cone C for use more easily as the distal end may extend outward and away from the waterpipe WP. In addition, smoke that may rise from the combusting material within the bowl may be spaced further away from the user's face during use.

Typical dimensions of pre-rolled cone mouthpieces $C_M$ are shown below:

Diameter D10 of cone mouthpiece lower end $C_L$: About 4.7 mm to 8.2 mm with an average diameter D10 of about 5.4 mm.

Diameter D9 of cone mouthpiece upper end $C_U$: About 6 mm to 10 mm with an average diameter D9 of about 7 mm.

Length $L_{CM}$ of cone mouthpiece $C_M$ between upper and lower ends $C_U$, $C_L$: About 21 mm to about 50 mm with an average length of about 26 mm.

Given the above, in some embodiments, the inventor has discovered that the length $L_P$ of the holder body 12 may preferably be at least about 3 mm to at least about 50 mm, and preferably at least about 10 mm to at least about 40 mm, and more preferably at least about 15 mm to at least about 30 mm, and more preferably at least about 15 mm to at least about 25 mm. The inventor also discovered that the diameter D7 of the upper openings 21 may preferably be about 4 mm to about 8 mm, and more preferably about 5 mm to about 7 mm, and more preferably about 5 mm to about 6 mm, and that the diameter D8 of the lower opening 22 may preferably be about 2 mm to about 6 mm, and preferably about 3 mm to about 5 mm, and more preferably about 4 mm to about 5 mm.

In addition, for the conical frustum shaped passageway 20 of FIGS. 6 and 8, the inventor has discovered that the passageway inner sidewall angle $\theta_P$ may include an outward angle of preferably about 0.1° to about 12°, and more preferably about 1° to about 10°, and more preferably about 2° to about 7°, and more preferably about 3° to about 6°, and more preferably about 4° to about 5°, and more preferably about 4.4°. Also, for the inverted conical frustum shaped passageway 20 of FIGS. 18-19, the inventor has discovered that the passageway inner sidewall angle $\theta_P$ may include an inward angle of preferably about 0.1° to about 12°, and more preferably about 1° to about 10°, and more preferably about 2° to about 7°, and more preferably about 3° to about 6°, and more preferably about 4° to about 5°, and more preferably about 4.4°.

Figure 22:
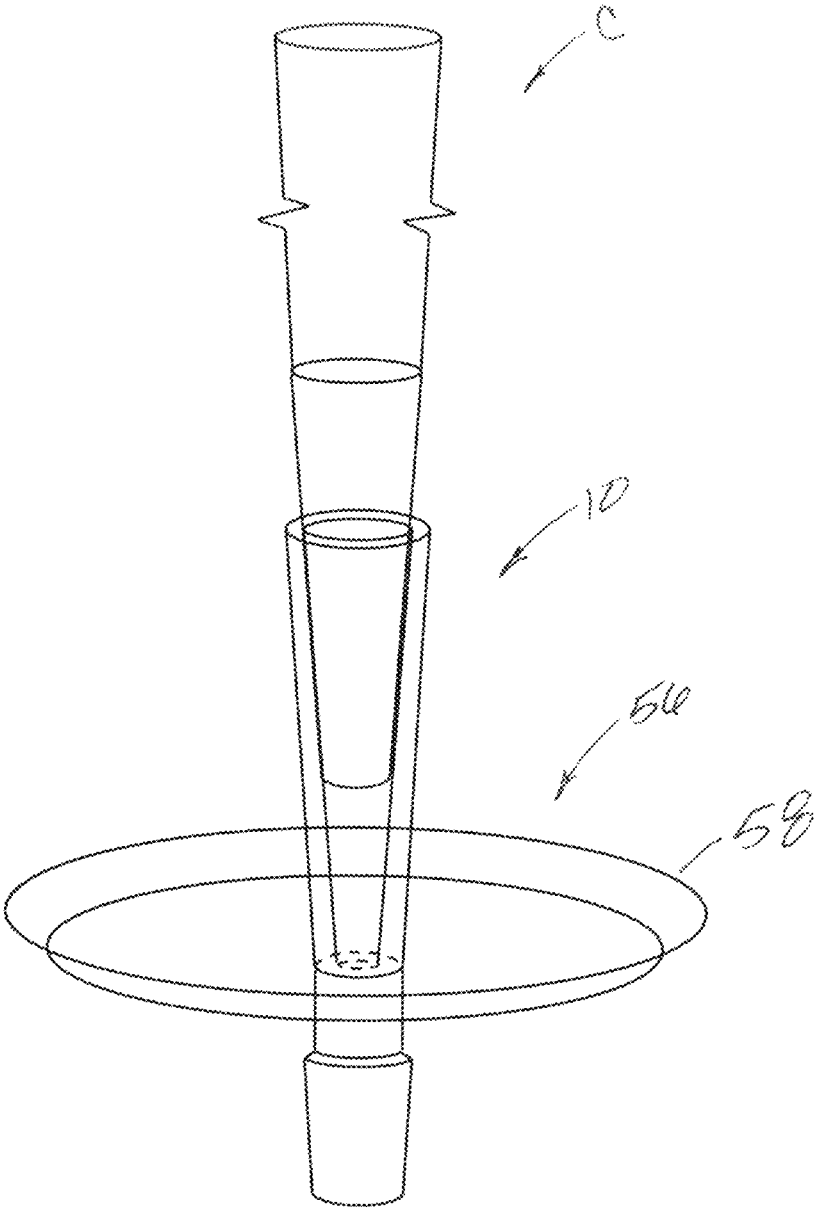
FIGS. 22-23 show aspects of a holder device and an ashtray according to exemplary embodiments hereof.
Figure 23:
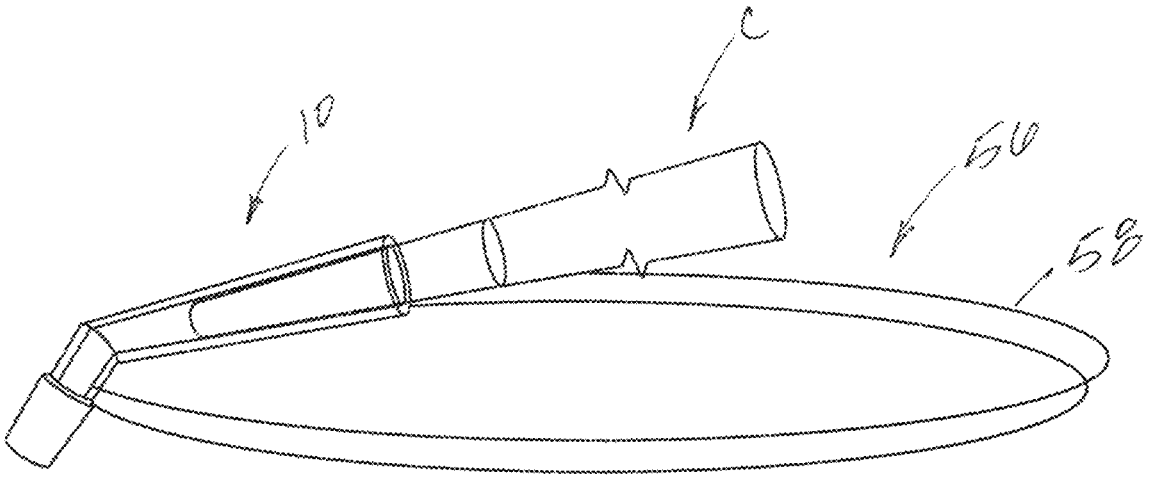

In any of the embodiments described herein, as shown in FIGS. 21 and 22, the holder device 10 may include an ashtray 56 designed to catch any ash that may fall from the ignited end of the cone pre-roll C during use. In some embodiments, as shown in FIG. 21, the ashtray 56 may be generally circular and may generally extend symmetrically outward from the holder device 10. It is understood that the ashtray 56 may be formed in other shapes such as square, polygonal, as other shapes, and/or as any combinations thereof. In this way, ash that may fall off the cone C in any direction may be caught by the ashtray 56. As such, this type of shape may be preferable for cones C that are held generally upright and/or at a small angle offset from vertical.

In other embodiments, as shown in FIG. 22, the ashtray 56 may be generally elongated (e.g., in the form of an oval, egg-shaped, rectangular, etc.) and may extend outward in a primary direction away from the holder device 10. As such, this type of shape may be preferable for cones C that are held at an angle (e.g., see FIG. 21) such that the ashtray 56 may be generally positioned below the ignited end of the cone C so it may catch any ash that may fall therefrom.

In some embodiments, as shown in FIGS. 21 and 22, the ashtray 56 may include a raised outer circumferential rim 58 that may help to contain any ash that may be caught by the ashtray 56.

In some embodiments, the ashtray 56 may be integrated into the holder device 10 (e.g., fixedly and/or permanently) while in other embodiments, the ashtray 56 may be detachable from and re-attachable to the holder device 10. In this way, the ashtray 56 may be removed to be cleaned and then reattached for use.

In some embodiments where the ashtray 56 may be detachable and re-attachable, the ashtray 56 may include a connection mechanism to releasably couple the ashtray 56 to the device 10. For example, the connection mechanism may include a through hole within the ashtray 56 through which a portion of the holder device 10 may extend through. In some embodiments, the through hole may include a diameter that is greater than the upper diameter of the holder device 10 such that the ashtray 56 may be installed from above. In this case, it may be preferable that the holder device 10 include an outer circumferential protrusion (e.g., a ridge or ledge) at a desired location of the ashtray 56 along the length of the device 10 that may include an outer diameter that is greater than the diameter of the through hole. In this way, the ashtray 56 may rest on the circumferential protrusion.

In another example, a portion of the holder device 10, e.g., the holder body 12, may be detachable to allow the ashtray 56 to be placed onto the holder device 10, e.g., onto the portion of the device 10 below the detached holder body 12. In this case, the portion of the device 10 below the holder body 12 may extend upward and through the ashtray's through hole. It may be preferable that the holder device 10 include an outer circumferential ledge, rim, or other type(s) of circumferential protrusions in this area upon which the ashtray 56 may rest.

In another example, the ashtray 56 may include an open slot that extends from its outer rim 58 to a center portion of the ashtray 56 that may be designed to receive a portion of the holder device 10. It may be preferable that the holder device 10 include side guides or similar structures upon which the ashtray 56 may rest and slide as the ashtray is slid onto the device 10. Detents or other similar mechanisms may be used to releasably hold the ashtray 56 in place during use.

In another example, the ashtray 56 may include two or more sections that may be separated from one another such that an unassembled ashtray 56 may be placed around the holder device 10 and then reassembled to couple the ashtray 56 thereto. For example, the ashtray 56 may include the through hole and also may separate into two halves about the through hole such that the ashtray 56 may be generally clamped onto the holder device 10. Other types of attachment mechanisms also may be used.

It is understood that any details and/or aspects of any embodiments of the holder device 10 described herein may be combined with any details and/or aspects of any other embodiments of the holder device 10 in any way to form additional embodiment(s) of the holder device 10 all of which are within the scope of the holder device 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCS" means "one or more ABCS" and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCS," means "two or more ABCS," and includes "two ABCS." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. A holder device for coupling an elongate combustible smokable item with a waterpipe, the holder device comprising:

a holder member including a holder first end and a holder second end, and including an inner passageway with inner passageway sidewalls extending from the holder first end to the holder second end, the inner passageway including a passageway first end with a passageway first diameter and a passageway second end with a passageway second diameter; and an adapter coupled to the holder second end and adapted to couple the holder member to a down stem associated with the waterpipe;

wherein the passageway second diameter is greater than the passageway first diameter.

2. The holder device of claim 1 wherein a length of the inner passageway is at least 5 mm.

3. The holder device of claim 1 wherein the passageway first end and the passageway second end define a passageway longitudinal axis, and the inner passageway sidewalls extend outward from the passageway first end to the passageway second end at an angle of about 0.1° to about 10° with respect to the passageway longitudinal axis.

4. The holder device of claim 1 wherein the inner passageway sidewalls extend linearly from the passageway first end to the passageway second end.

5. The holder device of claim 1 wherein the passageway second diameter is about 6 mm to about 10 mm.

6. The holder device of claim 1 wherein the passageway first end and the passageway second end define a passageway longitudinal axis, and the holder member includes an angular transition that translates the passageway longitudinal axis to an offset angle with respect to a longitudinal axis of the waterpipe's down stem.

7. The holder device of claim 1 wherein the passageway first end is at the holder first end.

8. The holder device of claim 1 wherein the passageway first end and the passageway second end define a passageway longitudinal axis, the holder device further comprising an ashtray coupled to the holder member and extending away from the holder member at an ashtray angle with respect to the passageway longitudinal axis, the holder member including a distal holder portion extending from an intermediate location between the holder first end and the holder second end to the holder first end, the distal holder portion separated from and positioned above the ashtray.

9. The holder device of claim 8 wherein the ashtray is detachable from the holder member.

10. The holder device of claim 1 wherein the passageway first diameter is about 4 mm to about 8 mm.

11. The holder device of claim 1 wherein the elongate combustible smokable item includes at least one of a pre-roll, a cigarette, a joint, a blunt, and a cigar.

12. A holder device for coupling an elongate combustible smokable item with a waterpipe, the holder device comprising:

a holder member including a holder first end and a holder second end, and including an inner passageway with inner passageway sidewalls extending from the holder first end to the holder second end, the inner passageway including a passageway first end with a passageway first diameter and a passageway second end with a passageway second diameter, the passageway first end and the passageway second end defining a passageway longitudinal axis;

an adapter coupled to the holder second end and adapted to couple the holder member to a down stem associated with the waterpipe, the down stem including a down stem longitudinal axis at a first offset angle with respect to an upward vertical axis; and an angular transition that sets the passageway longitudinal axis to a second offset angle with respect to the upward vertical axis wherein the second offset angle is greater than the first offset angle;

wherein the passageway first diameter is about 5 mm to about 8 mm; and wherein a length of the inner passageway is at least 5 mm.

13. The holder device of claim 12 wherein the second offset angle is about 20° to about 90°.

14. The holder device of claim 12 further comprising an ashtray coupled to the holder member and extending away from the holder member at an ashtray angle with respect to the passageway longitudinal axis, the holder member including a distal holder portion extending from an intermediate location between the holder first end and the holder second end to the holder first end, the distal holder portion separated from and positioned above the ashtray.

15. A holder device for coupling an elongate combustible smokable item with a waterpipe, the holder device comprising:

a holder member including a holder first end and a holder second end, and including an inner passageway with inner passageway sidewalls extending from the holder first end to the holder second end, the inner passageway including a passageway first end with a passageway first diameter and a passageway second end with a passageway second diameter;

an adapter coupled to the holder second end and adapted to couple the holder member to a down stem associated with the waterpipe; and wherein the holder member includes an angular transition at an intermediate location between the holder first end and the holder second end, wherein the holder first end and the intermediate location define a passageway first longitudinal axis, and the intermediate location and the holder second end define a passageway second longitudinal axis, wherein the passageway first longitudinal axis is at a first offset angle with respect to an upward vertical axis and the passageway second longitudinal axis is at a second offset angle with respect to the upward vertical axis, wherein the first offset angle is greater than the second offset angle;

wherein the passageway first diameter is about 4 mm to about 8 mm; and wherein a length of the inner passageway is at least 5 mm.

16. The holder device of claim 15 further comprising an ashtray coupled to the holder member and extending away from the holder member at an ashtray angle with respect to the passageway first longitudinal axis, the holder member including a distal holder portion extending from the intermediate location to the holder first end, the distal holder portion separated from and positioned above the ashtray.

* * * * *